US009790966B2

(12) United States Patent
Akiyama et al.

(10) Patent No.: US 9,790,966 B2
(45) Date of Patent: Oct. 17, 2017

(54) HYDRAULIC DRIVE SYSTEM

(75) Inventors: Teruo Akiyama, Kokubunji (JP); Noboru Iida, Chigasaki (JP); Koji Saito, Fujisawa (JP); Koji Yamashita, Yokohama (JP)

(73) Assignee: KOMATSU LTD., Tokyo (JP)

( * ) Notice: Subject to any disclaimer, the term of this patent is extended or adjusted under 35 U.S.C. 154(b) by 556 days.

(21) Appl. No.: 14/354,735

(22) PCT Filed: Sep. 11, 2012

(86) PCT No.: PCT/JP2012/073117

§ 371 (c)(1),
(2), (4) Date: Apr. 28, 2014

(87) PCT Pub. No.: WO2013/125079

PCT Pub. Date: Aug. 29, 2013

(65) Prior Publication Data

US 2014/0283510 A1 Sep. 25, 2014

(30) Foreign Application Priority Data

Feb. 23, 2012 (JP) ..... 2012-037233

(51) Int. Cl.
*F15B 15/02* (2006.01)
*E02F 9/22* (2006.01)
*F15B 11/17* (2006.01)

(52) U.S. Cl.
CPC ..... *F15B 15/02* (2013.01); *E02F 9/226* (2013.01); *E02F 9/2217* (2013.01);
(Continued)

(58) Field of Classification Search
CPC .. F15B 2211/20576; F15B 2211/20561; F15B 2211/6346; F15B 2211/785; E02F 9/2242
(Continued)

(56) References Cited

U.S. PATENT DOCUMENTS 5,179,836 A * 1/1993 Dantlgraber ..... F15B 7/006 60/414
6,220,028 B1 * 4/2001 Ishikawa ..... E02F 9/2235 60/431
(Continued)

FOREIGN PATENT DOCUMENTS

DE 10 2007 025 742 A1 12/2007
JP 59-177805 U 11/1984
(Continued)

OTHER PUBLICATIONS

Hydraulics & Pneumatics (Trinkel, Bud. "Book 2, Chapter 8: Directional Control Valves", Hydraulics & Pneumatics, Sep. 23, 2008. <ebook> retrieved on Sep. 6, 2016 <URL: http://hydraulicspneumatics.com/other-technologies/book-2-chapter-8-directional-control-valves>).*
(Continued)

*Primary Examiner* — Edelmira Bosques
*Assistant Examiner* — Richard Drake
(74) *Attorney, Agent, or Firm* — Global IP Counselors, LLP

(57) ABSTRACT

A shuttle valve connects a second flowpath and a drain flowpath when the hydraulic pressure in a first flowpath is greater than the hydraulic pressure in the second flowpath. The shuttle valve connects the first flowpath and the drain flowpath when the hydraulic pressure in a second flowpath is greater than the hydraulic pressure in the first flowpath. The ratio between the pressure receiving area of a first pressure section and the pressure receiving area of a second pressure section is the same as the ratio between the pressure receiving area of a first chamber side and the pressure receiving area of a second chamber side of a cylinder rod.

7 Claims, 12 Drawing Sheets

(52) U.S. Cl.
CPC ..... *E02F 9/2242* (2013.01); *E02F 9/2282* (2013.01); *E02F 9/2289* (2013.01); *E02F 9/2292* (2013.01); *E02F 9/2296* (2013.01); *F15B 11/17* (2013.01); *F15B 2211/20546* (2013.01); *F15B 2211/20561* (2013.01); *F15B 2211/20576* (2013.01); *F15B 2211/30525* (2013.01); *F15B 2211/327* (2013.01); *F15B 2211/613* (2013.01); *F15B 2211/633* (2013.01); *F15B 2211/6346* (2013.01); *F15B 2211/7053* (2013.01); *F15B 2211/785* (2013.01)

(58) Field of Classification Search
USPC ..... 60/464, 476, 431; 91/462
See application file for complete search history.

(56) References Cited

U.S. PATENT DOCUMENTS

| | | | | |
|---|---|---|---|---|
| 7,234,298 | B2 * | 6/2007 | Brinkman | E02F 9/2217 60/414 |
| 8,033,107 | B2 * | 10/2011 | Tikkanen | F15B 7/006 60/464 |
| 8,943,819 | B2 * | 2/2015 | Knussman | F15B 11/17 60/421 |
| 9,067,620 | B2 * | 6/2015 | Jang | B62D 5/30 |
| 2007/0079609 | A1 | 4/2007 | Brinkman et al. | |
| 2009/0064676 | A1 | 3/2009 | Tikkanen | |
| 2010/0332102 | A1 * | 12/2010 | Akiyama | E02F 9/2232 701/99 |
| 2012/0134848 | A1 * | 5/2012 | Nelson | E02F 9/226 417/53 |

FOREIGN PATENT DOCUMENTS

| | | | |
|---|---|---|---|
| JP | 60-139902 | A | 7/1985 |
| JP | 11-117907 | A | 4/1999 |
| JP | 2002-54602 | A | 2/2002 |
| JP | 2009-511831 | A | 3/2009 |
| JP | 2009-539043 | A | 11/2009 |
| JP | 2012-137187 | A | 7/2012 |

OTHER PUBLICATIONS

The Office Action for the corresponding German application No. 11 2012 004 874.1 dated Jul. 1, 2016.
The International Search Report for the corresponding international application No. PCT/JP2012/073117, dated Oct. 16, 2012.

* cited by examiner

HYDRAULIC DRIVE SYSTEM

CROSS-REFERENCE TO RELATED APPLICATIONS

This application is a U.S. National stage application of International Application No. PCT/JP2012/073117, filed on Sep. 11, 2012. This U.S. National stage application claims priority under 35 U.S.C. §119(a) to Japanese Patent Application No. 2012-037233, filed in Japan on Feb. 23, 2012, the entire contents of which are hereby incorporated herein by reference.

BACKGROUND

Field of the Invention

The present invention relates to a hydraulic drive system.

Background Art

Work machines, such as a hydraulic excavator or a wheel loader, are equipped with hydraulic cylinders. Hydraulic fluid discharged from a hydraulic pump is supplied to the hydraulic cylinder through a hydraulic circuit. For example, Japanese Laid-open Patent Publication No. 2002-54602 describes a work machine equipped with a hydraulic closed circuit for supplying hydraulic fluid to the hydraulic cylinders. Kinetic energy and potential energy of the members driven by the hydraulic cylinder are regenerated due to the hydraulic circuit being a closed circuit. As a result, fuel consumption of a driving source for driving the hydraulic pump can be reduced.

FIG. 12 illustrates an example of a conventional hydraulic circuit for driving a hydraulic cylinder 103. The hydraulic cylinder 103 includes a cylinder rod 103*a* and a cylinder tube 103*b*. The inside of the cylinder tube 103*b* is partitioned by the cylinder rod 103*a* into a first chamber 104 and a second chamber 105. The first chamber 104 is connected to a first hydraulic pump 101 via a first flowpath 106. The second chamber 105 is connected to the first hydraulic pump 101 via a second flowpath 107. In this way, the hydraulic cylinder 103 and the first hydraulic pump 101 are connected by a closed circuit. The hydraulic cylinder 103 expands due to the supply of hydraulic fluid to the first chamber 104 and the exhaust of hydraulic fluid from the second chamber 105. The hydraulic cylinder 103 contracts due to the supply of hydraulic fluid to the second chamber 105 and the exhaust of hydraulic fluid from the first chamber 104.

The pressure receiving area of the cylinder rod 103*a* on the second chamber 105 side is smaller than the pressure receiving area on the first chamber 104 side because the cylinder rod 103*a* is disposed to pass through the second chamber 105. Therefore, the amount of hydraulic fluid supplied to the first chamber 104 during the expansion of the hydraulic cylinder 103 is greater than the amount of hydraulic fluid exhausted from the second chamber 105. Further, the amount of hydraulic fluid supplied to the second chamber 105 during the contraction of the hydraulic cylinder 103 is less than the amount of hydraulic fluid exhausted from the first chamber 104. Accordingly, the first hydraulic pump 101 and a second hydraulic pump 102 are both disposed in the hydraulic circuit. During the expansion of the hydraulic cylinder 103, the hydraulic fluid discharged from the first hydraulic pump 101 and the second hydraulic pump 102 is supplied to the first chamber 104, and the hydraulic fluid exhausted from the second chamber 105 is recovered by the first hydraulic pump 101. During the contraction of the hydraulic cylinder 103, the hydraulic fluid discharged from the first hydraulic pump 101 is supplied to the second chamber 105, and the hydraulic fluid exhausted from the first chamber 104 is recovered by the first hydraulic pump 101 and the second hydraulic pump 102. In this case, the first hydraulic pump 101 and the second hydraulic pump 102 are controlled so that the ratio between the total discharge flow rate and the discharge flow rate of the first hydraulic pump 101 matches the ratio between the pressure receiving area of the first chamber 104 and the pressure receiving area of the second chamber 105. The total discharge flow rate is the sum of the discharge flow rate from the first hydraulic pump 101 and the discharge flow rate from the second hydraulic pump 102. For example, if the pressure receiving area ratio between the first chamber 104 and the second chamber 105 is 2:1, the first hydraulic pump 101 and the second hydraulic pump 102 are controlled so that the ratio between the total discharge flow rate and the discharge flow rate of the first hydraulic pump 101 is also 2:1. In other words, the first hydraulic pump 101 and the second hydraulic pump 102 are controlled so that the ratio between the discharge flow rate of the first hydraulic pump 101 and the discharge flow rate of the second hydraulic pump 102 is 1:1.

SUMMARY

The first hydraulic pump 101 and the second hydraulic pump 102 are controlled so that the total discharge flow rate of the first hydraulic pump 101 and the second hydraulic pump 102 when a working member, such as a working implement lever, is operated becomes a value that corresponds to the operation amount of the working member. At this time, it is difficult to control the discharge flow rate of the first hydraulic pump 101 and the discharge flow rate of the second hydraulic pump 102 while constantly maintaining the relationship of the abovementioned discharge flow rates with precision. For example, the discharge flow rate of the first hydraulic pump 101 and the discharge flow rate of the second hydraulic pump 102 may not match a command value due to a difference in volume efficiencies because of individual differences in the volume efficiencies of the hydraulic pumps. Alternatively, the discharge flow rate of the first hydraulic pump 101 and the discharge flow rate of the second hydraulic pump 102 may not satisfy the relationship of the discharge flow rate ratio appropriate for the command value due to differences in the responsiveness of the first hydraulic pump 101 and the second hydraulic pump 102. The following problems may arise if the ratio between the discharge flow rate of the first hydraulic pump 101 and the discharge flow rate of the second hydraulic pump 102 does not satisfy the relationship between the abovementioned discharge flow rate ratio.

For example, a case is assumed hereinbelow in which the hydraulic cylinder 103 is a boom cylinder and an operation for raising the boom is conducted. The pressure receiving area ratio between the first chamber 104 and the second chamber 105 is 2:1. In this case, a target discharge flow rate of the first hydraulic pump 101 and a target discharge flow rate of the second hydraulic pump 102 are set so that the ratio between the discharge flow rate of the first hydraulic pump 101 and the discharge flow rate of the second hydraulic pump 102 becomes 1:1. However, as illustrated in FIG. 12, the actual discharge flow rate of the first hydraulic pump 101 is "0.95" and the actual discharge flow rate of the second hydraulic pump 102 is "1.05." In this case, hydraulic fluid at a flow rate of "2.0 (=0.95+1.05)" is supplied to the first chamber 104 of the hydraulic cylinder 103. Hydraulic fluid at a flow rate of "1.0" is exhausted from the second chamber 105. However, the first hydraulic pump 101 is only able to suck in hydraulic fluid at a flow rate of "0.95" because the discharge flow rate of the first hydraulic pump 101 is "0.95." As a result, an excess flow rate corresponding to the difference between "1.0" and "0.95" is generated in the second flowpath 107. When the hydraulic pressure of the second flowpath 107 rises up to the relief pressure of a relief valve 108, the relief valve 108 is opened and the hydraulic fluid of the excess flow rate is exhausted to a charge circuit 109. Because the load applied to the hydraulic cylinder 103 during the raising operation of the boom acts on the hydraulic fluid in the first chamber 104, there is no need for the hydraulic pressure in the second flowpath 107 to rise. Therefore, the energy for raising the hydraulic fluid of the excess flow rate in the second flowpath 107 as described above is wasted energy. Moreover, the hydraulic pressure in the first flowpath 106 needs to be greater than the hydraulic pressure in the second flowpath 107 to expand the hydraulic cylinder 103. Therefore, the hydraulic pressure in the first flowpath 106 needs to be increased even more to be greater than the hydraulic pressure in the second flowpath 107. In this case, if the horsepower for driving the first hydraulic pump 101 and the second hydraulic pump 102 does not change, the flow rate of the hydraulic fluid discharged from the first hydraulic pump 101 and the second hydraulic pump 102 is reduced. As a result, the operation speed of the hydraulic cylinder 103 decreases and workability is reduced.

Next, a case is assumed hereinbelow in which a hydraulic cylinder is a boom cylinder and an operation for lowering the boom is conducted. As illustrated in FIG. 13, the actual discharge flow rate of the first hydraulic pump 101 is "1.05" and the actual discharge flow rate of the second hydraulic pump 102 is "0.95." When lowering the boom, the hydraulic cylinder 103 contracts while the load due to the deadweight of the working implement, including the boom, acts on the hydraulic fluid in the first chamber 104. In this case, when the hydraulic fluid at a flow rate of "2.0" is exhausted from the first chamber 104 of the hydraulic cylinder 103, the hydraulic fluid at a flow rate of "1.0" is sucked into the second chamber 105. However, the second hydraulic pump 102 is only able to suck in hydraulic fluid at a flow rate of "1.0" whereas the discharge flow rate of the first hydraulic pump 101 is "1.05." As a result, the hydraulic pressure of the second flowpath 107 rises up to the relief pressure in the same way as described above. In this case, a pumping action is conducted by the first hydraulic pump 101 to increase the hydraulic pressure of the first flowpath 106 up to the hydraulic pressure of the second flowpath 107. Therefore, the first hydraulic pump 101 is not able to regenerate the potential energy of the working implement.

An object of the present invention is to provide a hydraulic drive system that is able to suppress a rise in hydraulic pressure even when a deviation in discharge flow rate control between hydraulic pumps occurs in a hydraulic circuit in which a closed circuit is configured between a hydraulic pump and a hydraulic cylinder.

A hydraulic drive system according to a first exemplary embodiment of the present invention includes a first hydraulic pump, a hydraulic cylinder, a hydraulic fluid flowpath, a hydraulic fluid tank, a second hydraulic pump, a charge circuit, a pump control unit, and a shuttle valve. The first hydraulic pump has a first closed-circuit port and a second closed-circuit port. The first hydraulic pump is switchable between a first discharge state and a second discharge state. The first hydraulic pump sucks in hydraulic fluid from the second closed-circuit port and discharges hydraulic fluid from the first closed-circuit port in the first discharge state. The first hydraulic pump sucks in hydraulic fluid from the first closed-circuit port and discharges hydraulic fluid from the second closed-circuit port in the second discharge state. The hydraulic cylinder includes a cylinder rod and a cylinder tube. The inside of the cylinder tube is partitioned by the cylinder rod into a first chamber and a second chamber. The pressure receiving area on the first chamber side of the cylinder rod is larger than the pressure receiving area on the second chamber side. The cylinder rod expands due to hydraulic fluid being supplied to the first chamber and hydraulic fluid being exhausted from the second chamber. The cylinder rod contracts due to hydraulic fluid being supplied to the second chamber and hydraulic fluid being exhausted from the first chamber. The hydraulic fluid flowpath has a first flowpath and a second flowpath. The first flowpath connects the first closed-circuit port and the first chamber. The second flowpath connects the second closed-circuit port and the second chamber. The hydraulic fluid tank stores hydraulic fluid. The second hydraulic pump has a first open-circuit port and a second open-circuit port. The first open-circuit port is connected to the first flowpath. The second open-circuit port is connected to the hydraulic fluid tank. The second hydraulic pump is switchable between a first discharge state and a second discharge state. The second hydraulic pump sucks in hydraulic fluid from the second open-circuit port and discharges hydraulic fluid from the first open-circuit port in the first discharge state. The second hydraulic pump sucks in hydraulic fluid from the first open-circuit port and discharges hydraulic fluid from the second open-circuit port in the second discharge state. The charge circuit has a charge flowpath and a charge pump. The charge flowpath is connected to the hydraulic fluid flowpath. The charge pump discharges hydraulic fluid into the charge flowpath. The charge circuit replenishes hydraulic fluid to the hydraulic fluid flowpath when the hydraulic pressure in the hydraulic fluid flowpath is lower than the hydraulic pressure in the charge flowpath. The pump control unit controls the discharge flow rate of the first hydraulic pump and the discharge flow rate of the second hydraulic pump so that a ratio of the discharge flow rate of the first hydraulic pump with respect to the sum of the discharge flow rate of the first hydraulic pump and the discharge flow rate of the second hydraulic pump equals a ratio of the pressure receiving area in the second chamber with respect to the pressure receiving area in the first chamber. The shuttle valve has a first input port, a second input port, a drain port, a first pressure receiving section, and a second pressure receiving section. The first input port is connected to the first flowpath. The second input port is connected to the second flowpath. The drain port is connected to the hydraulic fluid tank or to the charge flowpath. The hydraulic pressure of the first flowpath is applied to the first pressure receiving section. The hydraulic pressure of the second flowpath is applied to the second pressure receiving section. The shuttle valve enters a first position state when a force applied to the first pressure receiving section by the hydraulic pressure in the first flowpath exceeds a force applied to the second pressure receiving section by the hydraulic pressure in the second flowpath. The shuttle valve allows communication between the second input port and the drain port in the first position state. The shuttle valve enters a second position state when a force applied to the second pressure receiving section by the hydraulic pressure in the second flowpath exceeds a force applied to the first pressure receiving section by the hydraulic pressure in the first flowpath. The shuttle valve allows communication between the first input port and the drain port in the second position state. The ratio between the pressure receiving area of a first pressure section and the pressure receiving area of a second pressure section is the same as the ratio between the pressure receiving area of the first chamber side and the pressure receiving area of the second chamber side of the cylinder rod.

A hydraulic drive system according to a second exemplary embodiment of the present invention is related to the hydraulic drive system of the first exemplary embodiment, wherein the shuttle valve has a spool, a first elastic member, and a second elastic member. The first elastic member presses the spool from the first pressure receiving section side toward the second pressure receiving section side. The second elastic member presses the spool from the second pressure receiving section side toward the first pressure receiving section side. A ratio between the elastic constant of the first elastic member and the elastic constant of the second elastic member has an inverse relationship with the ratio between the pressure receiving area of the first pressure receiving section and the pressure receiving area of the second pressure receiving section.

A hydraulic drive system according to a third exemplary embodiment of the present invention is related to the hydraulic drive system of the second exemplary embodiment, wherein the first elastic member is attached so as to press the spool with a first attachment load when the spool is in the neutral position. The second elastic member is attached to press the spool with a second attachment load when the spool is in the neutral position. A ratio between the first attachment load and the second attachment load has an inverse relationship with the ratio between the pressure receiving area of the first pressure receiving section and the pressure receiving area of the second pressure receiving section.

A hydraulic drive system according to a fourth exemplary embodiment of the present invention is related to any one of the first to third exemplary embodiments, and further includes an operating member, a switching valve, and an adjustment flowpath. The operating member is operable in a direction for expanding the hydraulic cylinder from the neutral position, and a direction for contracting the hydraulic cylinder from the neutral position. The switching valve is disposed between the first hydraulic pump and the hydraulic cylinder in the hydraulic fluid flowpath. The adjustment flowpath is connected to the hydraulic fluid tank or to the charge flowpath. The first flowpath has a first pump flowpath connected to the first closed-circuit port, and a first cylinder flowpath connected to the first chamber. The second flowpath has a second pump flowpath connected to the second closed-circuit port, and a second cylinder flowpath connected to the second chamber. The switching valve connects the first pump flowpath and the second pump flowpath to the adjustment flowpath when the operating member is positioned in the neutral position.

A hydraulic drive system according to a fifth exemplary embodiment of the present invention is related to the hydraulic drive system of any one of the first to third exemplary embodiments, wherein the shuttle valve allows the first input port and the second input port to communicate with the drain port in the neutral position state.

When the hydraulic cylinder expands with resistance to an external force in the hydraulic drive system according to the first exemplary embodiment of the present invention, the shuttle valve allows communication between the second input port and the drain port. As a result, a rise in the hydraulic pressure in the second flowpath is suppressed even if the discharge flow rate of the first hydraulic pump is less than the discharge flow rate of the second hydraulic pump. Moreover, when the hydraulic cylinder contracts upon receiving an external force, the shuttle valve allows communication between the second input port and the drain port. As a result, a rise in the hydraulic pressure in the second flowpath is suppressed even if the discharge flow rate of the first hydraulic pump is greater than the discharge flow rate of the second hydraulic pump. As a result, the rise in hydraulic pressure may be suppressed even when a deviation in discharge flow rate control between the hydraulic pumps occurs in a hydraulic circuit in which a closed circuit is configured between a hydraulic pump and a hydraulic cylinder in the hydraulic drive system according to the present exemplary embodiment.

The following is an explanation of the reason that the ratio between the pressure receiving area of a first pressure section and the pressure receiving area of a second pressure section is the same as the ratio between the pressure receiving area of the first chamber side and the pressure receiving area of the second chamber side of the cylinder rod. A case in which the cylinder rod is expanded with resistance to an external force will be examined as an example. The hydraulic pressure of the first chamber is assumed to be P1 and the hydraulic pressure of the second chamber is assumed to be P2 when a load due to an external force acting on the cylinder rod is ignored. In this case, the hydraulic pressure of the first flowpath is considered to be the same as the hydraulic pressure P1 of the first chamber since any pressure drop in the flowpath is small. Similarly, the hydraulic pressure of the second flowpath is considered to be the same as the hydraulic pressure P2 of the second chamber. The pressure receiving area on the first chamber side of the cylinder rod is assumed to be A1 and the pressure receiving area on the second chamber side of the cylinder rod is assumed to be A2. In this case, $P1 \times A1 = P2 \times A2$. Therefore, if for example, A1:A2=2:1, then P1=(1/2) P2. That is, P1 is a smaller value than P2. When a cylinder piston is driven with the hydraulic pressure of the first chamber, the hydraulic pressure for resisting the load from an external force on the cylinder rod is assumed to be $\alpha$. $\alpha$ becomes smaller as the load becomes smaller. As a result, when the load is small, the first flowpath hydraulic pressure $P1+\alpha$ becomes a value smaller than the second flowpath hydraulic pressure P2. Therefore, when a pressure receiving area S1 of the first pressure receiving section of the shuttle valve is equal to a pressure receiving area S2 of the second pressure receiving section, a force "$(p1+\alpha)\times S1$" that acts on the first pressure receiving section is smaller than a force "$P2\times S2$" that acts on the second pressure receiving section. As a result, the shuttle valve becomes connected to the charge flowpath or to the hydraulic fluid tank of the first flowpath but cannot be connected to the charge flowpath or to the hydraulic fluid tank of the second flowpath. In the hydraulic drive system according to the present exemplary embodiment, the ratio between the pressure receiving area S1 of the first pressure receiving section and the pressure receiving area S2 of the second pressure receiving section is equal to the ratio between the pressure receiving area A1 of the first chamber and the pressure receiving area A2 of the second chamber. As a result, $P1\times S1=P2\times S2$ when the hydraulic pressure a for resisting the load from the external force on the cylinder rod is ignored. Therefore, the force "$(P1+\alpha)\times S1$" acting on the first pressure receiving section is larger than the force "$P2\times S2$" acting on the second pressure receiving section by the amount of "$\alpha\times S1$" when the hydraulic pressure a for resisting the load from the external force on the cylinder rod is considered. Specifically, even when the load is small, the second flowpath is able to be connected to the charge flowpath or to the hydraulic fluid tank because the shuttle valve allows communication between the second input port and the drain port. Similarly, a case in which an external force is received and the piston rod contracts will be examined. Here, the force "(p1+α)×S1" acting on the first pressure receiving section is larger than the force "P2×S2" acting on the second pressure receiving section by the amount of "α×S1" when the hydraulic pressure for resisting the external force is assumed to be α. Specifically, in this case as well, the shuttle valve connects the second flowpath to the charge flowpath or to the hydraulic fluid tank. In this way, because the flowpath in which the hydraulic pressure does not need to be raised is connected to the charge flowpath or to the hydraulic fluid tank via the shuttle valve, an unnecessary rise in hydraulic pressure may be suppressed.

In the hydraulic drive system according to the second exemplary embodiment of the present invention, the ratio between the elastic constant of the first elastic member and the elastic constant of the second elastic member has an inverse relationship with the ratio between the pressure receiving area of the first pressure receiving section and the pressure receiving area of the second pressure receiving section. As a result, switching characteristics of the shuttle valve approximate each other when the shuttle valve spool moves from the neutral position toward the first pressure receiving section and when the shuttle valve spool moves from the neutral position toward the second pressure receiving section.

In the hydraulic drive system according to the third exemplary embodiment of the present invention, the ratio between the first attachment load and the second attachment load has an inverse relationship with the ratio between the pressure receiving area of the first pressure receiving section and the pressure receiving area of the second pressure receiving section. As a result, switching characteristics of the shuttle valve approximate each other when the shuttle valve spool moves from the neutral position toward the first pressure receiving section and when the shuttle valve spool moves from the neutral position toward the second pressure receiving section.

In the hydraulic drive system according to the fourth exemplary embodiment of the present invention, hydraulic fluid is exhausted to the hydraulic fluid tank or to the charge flowpath via the adjustment flowpath even if the discharge flow rate of the first hydraulic pump and/or the second hydraulic pump is not zero when the operating member is in the neutral position. As a result, a rise in the hydraulic pressure of the first flowpath and/or the second flowpath may be suppressed.

In the hydraulic drive system according to the fifth exemplary embodiment of the present invention, hydraulic fluid is exhausted to the hydraulic fluid tank or to the charge flowpath via a drain port even if the discharge flow rate of the first hydraulic pump and/or the second hydraulic pump is not zero when the operating member is in the neutral position. As a result, a rise in the hydraulic pressure of the first flowpath and/or the second flowpath may be suppressed.

DESCRIPTION OF EXEMPLARY EMBODIMENTS

A hydraulic drive system according to an exemplary embodiment of the present invention shall be explained in detail with reference to the figures.

Figure 1:
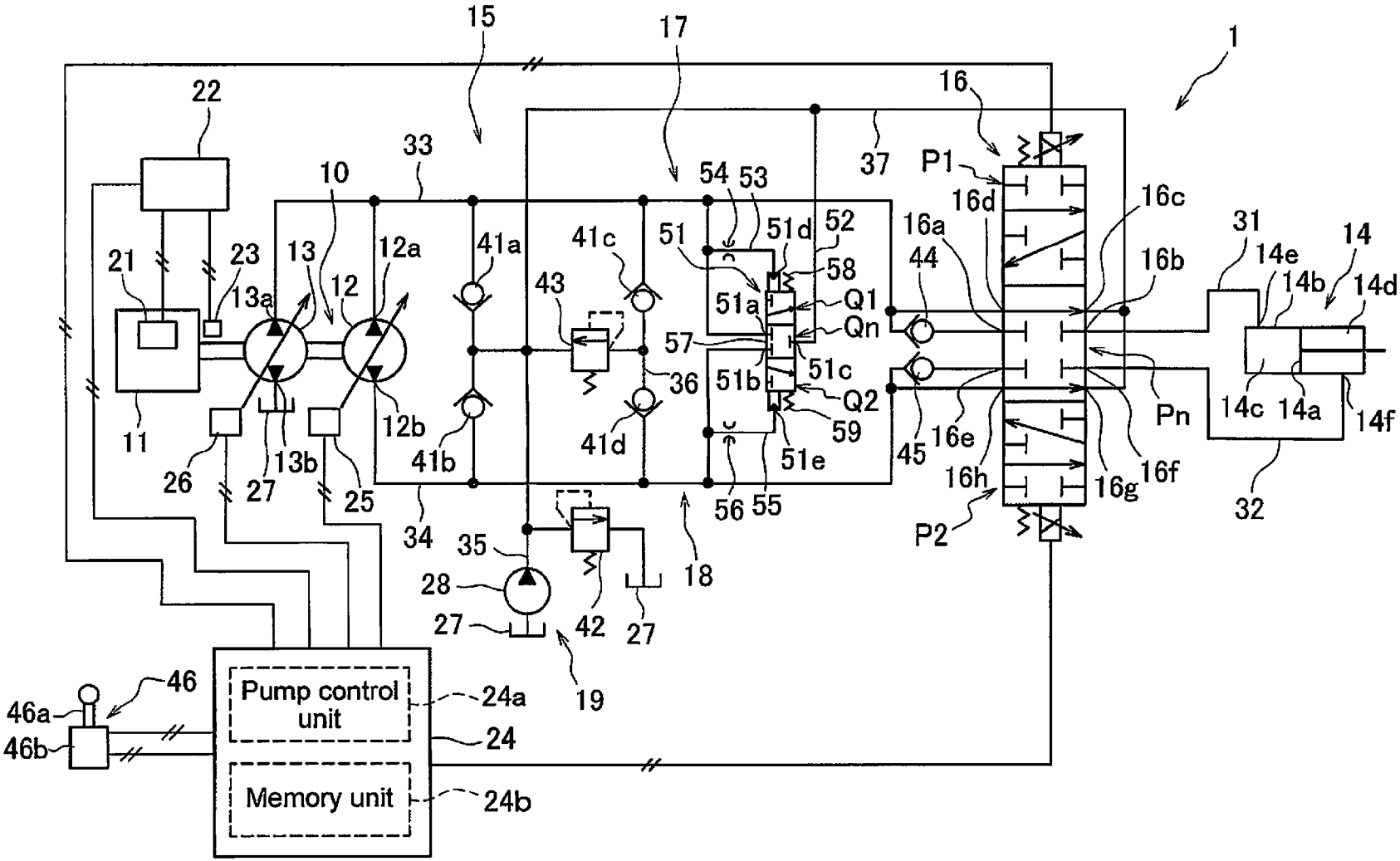
FIG. 1 is a block diagram of a configuration of a hydraulic drive system according to an exemplary embodiment of the present invention.

FIG. 1 is a block diagram of a configuration of a hydraulic drive system 1 according to an exemplary embodiment of the present invention. The hydraulic drive system 1 is installed on a work machine, such as a hydraulic excavator, a wheel loader, or a bulldozer. The hydraulic drive system 1 includes an engine 11, a main pump 10, a hydraulic cylinder 14, a hydraulic fluid flowpath 15, a flowpath switching valve 16, a shuttle valve 51, an engine controller 22, and a pump controller 24.

The engine 11 drives the main pump 10. The engine 11 is a diesel engine, for example, and the output of the engine 11 is controlled by adjusting an injection amount of fuel from a fuel injection pump 21. The adjustment of the fuel injection amount is performed by the engine controller 22 controlling the fuel injection device 21. An actual rotation speed of the engine 11 is detected by a rotation speed sensor 23, and a detection signal is input into the engine controller 22 and the pump controller 24.

The main pump 10 is driven by the engine 11 to discharge hydraulic fluid. The main pump 10 includes a first hydraulic pump 12 and a second hydraulic pump 13. Hydraulic fluid discharged from the main pump 10 is supplied to the hydraulic cylinder 14 via the flowpath switching valve 16.

The first hydraulic pump 12 is a variable displacement hydraulic pump. The displacement of the first hydraulic pump 12 is controlled by controlling a tilt angle of the first hydraulic pump 12. The tilt angle of the first hydraulic pump 12 is controlled by a first pump-flow-rate control unit 25. The first pump-flow-rate control unit 25 controls the displacement of the first hydraulic pump 12 by controlling the tilt angle of the first hydraulic pump 12 on the basis of a command signal from the pump controller 24. As a result, the discharge flow rate of the first hydraulic pump 12 is controlled. In the present exemplary embodiment, the discharge flow rate of the first hydraulic pump 12 corresponds to the displacement of the first hydraulic pump 12. The discharge flow rate of the second hydraulic pump 13 corresponds to the displacement of the second hydraulic pump 13. The first hydraulic pump 12 is a two-directional discharge hydraulic pump. Specifically, the first hydraulic pump 12 has a first closed-circuit port 12*a* and a second closed-circuit port 12*b*. The first hydraulic pump 12 is switchable between a first discharge state and a second discharge state. The first hydraulic pump 12 sucks in hydraulic fluid from the second closed-circuit port 12*b* and discharges hydraulic fluid from the first closed-circuit port 12*a* in the first discharge state. The first hydraulic pump 12 sucks in hydraulic fluid from the first closed-circuit port 12*a* and discharges hydraulic fluid from the second closed-circuit port 12*b* in the second discharge state.

The second hydraulic pump 13 is a variable displacement hydraulic pump. The displacement of the second hydraulic pump 13 is controlled by controlling the tilt angle of the second hydraulic pump 13. The tilt angle of the second hydraulic pump 13 is controlled by a second pump-flow-rate control unit 26. The second pump-flow-rate control unit 26 controls the displacement of the second hydraulic pump 13 by controlling the tilt angle of the second hydraulic pump 13 on the basis of a command signal from the pump controller 24. The second hydraulic pump 13 is a two-directional discharge hydraulic pump. Specifically, the second hydraulic pump 13 has a first open-circuit port 13*a* and a second open-circuit port 13*b*. The second hydraulic pump 13 is switchable between the first discharge state and the second discharge state in the same way as the first hydraulic pump 12. The second hydraulic pump 13 sucks in hydraulic fluid from the second open-circuit port 13*b* and discharges hydraulic fluid from the first open-circuit port 13*a* in the first discharge state. The second hydraulic pump 13 sucks in hydraulic fluid from the first open-circuit port 13*a* and discharges hydraulic fluid from the second open-circuit port 13*b* in the second discharge state.

The hydraulic cylinder 14 is driven by hydraulic fluid discharged from the main pump 10. The hydraulic cylinder 14 drives working implements, such as a boom, an arm, or a bucket. The hydraulic cylinder 14 includes a cylinder rod 14*a* and a cylinder tube 14*b*. The inside of the cylinder tube 14*b* is partitioned by the cylinder rod 14*a* into a first chamber 14*c* and a second chamber 14*d*. The hydraulic cylinder 14 has a first cylinder port 14*e* and a second cylinder port 14*f*. The first cylinder port 14*e* communicates with the first chamber 14*c*. The second cylinder port 14*f* communicates with the second chamber 14*d*. The hydraulic cylinder 14 is switchable between a state in which hydraulic fluid is supplied to the second cylinder port 14*f* and hydraulic fluid is exhausted from the first cylinder port 14*e*, and a state in which hydraulic fluid is supplied to the first cylinder port 14*e* and hydraulic fluid is exhausted from the second cylinder port 14*f*. The hydraulic cylinder 14 expands and contracts by switching between the supply and exhaust of hydraulic fluid to and from the first chamber 14*c* and the second chamber 14*d*. Specifically, the hydraulic cylinder 14 expands due to hydraulic fluid being supplied to the first chamber 14*c* via the first cylinder port 14*e*, and hydraulic fluid being exhausted from the second chamber 14*d* via the second cylinder port 14*f*. The hydraulic cylinder 14 contracts due to hydraulic fluid being supplied to the second chamber 14*d* via the second cylinder port 14*f*, and hydraulic fluid being exhausted from the first chamber 14*c* via the first cylinder port 14*e*. The pressure receiving area on the first chamber 14*c* side of the cylinder rod 14*a* (referred to below simply as "pressure receiving area of the first chamber 14*c*") is larger than the pressure receiving area on the second chamber 14*d* side of the cylinder rod 14*a* (referred to below simply as "pressure receiving area of the second chamber 14*d*"). Therefore, when the hydraulic cylinder 14 is expanded, more hydraulic fluid is supplied to the first chamber 14*c* than is exhausted from the second chamber 14*d*. When the hydraulic cylinder 14 is contracted, more hydraulic fluid is exhausted from the first chamber 14*c* than is supplied to the second chamber 14*d*.

The hydraulic fluid flowpath 15 connects the first hydraulic pump 12 and the second hydraulic pump 13 to the hydraulic cylinder 14. Specifically, the hydraulic fluid flowpath 15 includes a first flowpath 17 and a second flowpath 18. The first flowpath 17 connects the first closed-circuit port 12*a* of the first hydraulic pump 12 with the first cylinder port 14*e*. The first flowpath 17 connects the first open-circuit port 13*a* of the second hydraulic pump 13 with the first cylinder port 14*e*. The second flowpath 18 connects the second closed-circuit port 12*b* of the first hydraulic pump 12 with the second cylinder port 14*f*. The first flowpath 17 has a first cylinder flowpath 31 and a first pump flowpath 33. The second flowpath 18 has a second cylinder flowpath 32 and a second pump flowpath 34. The first cylinder flowpath 31 is connected to the first chamber 14*c* via the first cylinder port 14*e*. The second cylinder flowpath 32 is connected to the second chamber 14*d* via the second cylinder port 14*f*. The first pump flowpath 33 is a path for supplying hydraulic fluid to the first chamber 14*c* via the first cylinder flowpath 31, or for recovering hydraulic fluid from the first chamber 14*c* via the first cylinder flowpath 31. The first pump flowpath 33 is connected to the first closed-circuit port 12*a* of the first hydraulic pump 12. The first pump flowpath 33 is connected to the first open-circuit port 13*a* of the second hydraulic pump 13. Therefore, hydraulic fluid is supplied to the first pump flowpath 33 from both the first hydraulic pump 12 and the second hydraulic pump 13. The second pump flowpath 34 is a path for supplying hydraulic fluid to the second chamber 14*d* via the second cylinder flowpath 32, or for recovering hydraulic fluid from the second chamber 14*d* via the second cylinder flowpath 32. The second pump flowpath 34 is connected to the second closed-circuit port 12*b* of the first hydraulic pump 12. The second open-circuit port 13*b* of the second hydraulic pump 13 is connected to a hydraulic fluid tank 27 that stores the hydraulic fluid. Therefore, hydraulic fluid is supplied to the second pump flowpath 34 from the first hydraulic pump 12. The hydraulic fluid flowpath 15 configures a closed circuit between the first hydraulic pump 12 and the hydraulic cylinder 14 with the first pump flowpath 33, the first cylinder flowpath 31, the second cylinder flowpath 32, and the second pump flowpath 34. The hydraulic fluid flowpath 15 configures an open circuit between the second hydraulic pump 13 and the hydraulic cylinder 14 with the first pump flowpath 33 and the first cylinder flowpath 31.

The hydraulic drive system 1 is further provided with a charge circuit 19. The charge circuit 19 has a charge flowpath 35 and a charge pump 28. The charge pump 28 is a hydraulic pump for replenishing hydraulic fluid to the hydraulic fluid flowpath 15. The charge pump 28 is driven by the engine 11 to discharge hydraulic fluid to the charge flowpath 35. The charge pump 28 is a fixed displacement hydraulic pump. The charge flowpath 35 connects the charge pump 28 with the hydraulic fluid flowpath 15. The charge flowpath 35 is connected between the main pump 10 and a first check valve 44 in the hydraulic fluid flowpath 15. Specifically, the charge path flowpath 35 is connected to the first pump flowpath 33 via a check valve 41*a*. The check valve 41*a* is open when the hydraulic pressure of the first pump flowpath 33 is lower than the charge pressure of the charge flowpath 35. The charge flowpath 35 is connected between the main pump 10 and a second check valve 45 in the hydraulic fluid flowpath 15. Specifically, the charge flowpath 35 is connected to the second pump flowpath 34 via a check valve 41*b*. The check valve 41*b* is open when the hydraulic pressure of the second pump flowpath 34 is lower than the charge pressure. As a result, the charge circuit 19 replenishes hydraulic fluid to the hydraulic fluid flowpath 15 when the hydraulic pressure in the hydraulic fluid flowpath 15 is lower than the charge pressure. The charge flowpath 35 is connected to the hydraulic fluid tank 27 via a charge relief valve 42. The charge relief valve 42 maintains the charge pressure at a certain setting pressure. When the hydraulic pressure of the first pump flowpath 33 or the second pump flowpath 34 becomes lower than the charge pressure, hydraulic fluid from the charge pump 28 is supplied to the first pump flowpath 33 or the second pump flowpath 34 via the charge flowpath 35. As a result, the hydraulic pressure of the first pump flowpath 33 or the second pump flowpath 34 is maintained at a predetermined value or higher.

The hydraulic fluid flowpath 15 further includes a relief flowpath 36. The relief flowpath 36 is connected to the first pump flowpath 33 via a check valve 41*c*. The check valve 41*c* is open when the hydraulic pressure of the first pump flowpath 33 is higher than the hydraulic pressure of the relief flowpath 36. The relief flowpath 36 is connected to the second pump flowpath 34 via a check valve 41*d*. The check valve 41*d* is open when the hydraulic pressure of the second pump flowpath 34 is higher than the hydraulic pressure of the relief flowpath 36. The relief flowpath 36 is connected to the charge flowpath 35 via a relief valve 43. The relief valve 43 maintains the pressure of the relief flowpath 36 at a pressure equal to or less than a predetermined relief pressure. As a result, the hydraulic pressure of the first pump flowpath 33 and the second pump flowpath 34 is maintained at a pressure equal to or less than the predetermined relief pressure. The hydraulic fluid flowpath 15 further includes an adjustment flowpath 37. The adjustment flowpath 37 is connected to the charge flowpath 35.

The flowpath switching valve 16 is an electromagnetic control valve controlled on the basis of a command signal from the pump controller 24. The flowpath switching valve 16 switches flowpath connections on the basis of a command signal from the pump controller 24. The flowpath switching valve 16 is disposed between the first hydraulic pump 12 and the hydraulic cylinder 14 in the hydraulic fluid flowpath 15. The flowpath switching valve 16 includes a first pump port 16*a*, a first cylinder port 16*b*, a first adjustment port 16*c*, and a first bypass port 16*d*. The first pump port 16*a* is connected to the first pump flowpath 33 via the first check valve 44. The first cylinder port 16*b* is connected to the first cylinder flowpath 31. The first adjustment port 16*c* is connected to the adjustment flowpath 37.

The first check valve 44 is disposed between the main pump 10 and the hydraulic cylinder 14 in the hydraulic fluid flowpath 15. The first check valve 44 allows the flow of hydraulic fluid from the main pump 10 toward the hydraulic cylinder 14. The first check valve 44 prohibits the flow of hydraulic fluid from the hydraulic cylinder 14 toward the main pump 10. Specifically, the first check valve 44 allows the flow of hydraulic fluid from the first pump flowpath 33 toward the first cylinder flowpath 31 and prohibits the flow of hydraulic fluid from the first cylinder flowpath 31 toward the first pump flowpath 33 when hydraulic fluid is supplied to the first cylinder flowpath 31 from the first pump flowpath 33 by the flowpath switching valve 16.

The flowpath switching valve 16 further includes a second pump port 16*e*, a second cylinder port 16*f*, a second adjustment port 16*g*, and a second bypass port 16*h*. The second pump port 16*e* is connected to the second pump flowpath 34 via a second check valve 45. The second check valve 45 is a check valve for restricting the flow of hydraulic fluid to one direction. The second cylinder port 16*f* is connected to the second cylinder flowpath 32. The second adjustment port 16*g* is connected to the adjustment flowpath 37.

The second check valve 45 is disposed between the main pump 10 and the hydraulic cylinder 14 in the hydraulic fluid flowpath 15. The second check valve 45 allows the flow of hydraulic fluid from the main pump 10 toward the hydraulic cylinder 14. The second check valve 45 prohibits the flow of hydraulic fluid from the hydraulic cylinder 14 toward the main pump 10. Specifically, the second check valve 45 allows the flow of hydraulic fluid from the second pump flowpath 34 toward the second cylinder flowpath 32 and prohibits the flow of hydraulic fluid from the second cylinder flowpath 32 toward the second pump flowpath 34 when hydraulic fluid is supplied to the second cylinder flowpath 32 from the second pump flowpath 34 by the flowpath switching valve 16.

The flowpath switching valve 16 is switchable between a first position state P1, a second position state P2, and a neutral position state Pn. The flowpath switching valve 16 allows communication between the first pump port 16*a* and the first cylinder port 16*b* and between the second cylinder port 16*f* and the second bypass port 16*h* in the first position state P1. Therefore, the flowpath switching valve 16 connects the first pump flowpath 33 to the first cylinder flowpath 34 via the first check valve 44 and connects the second cylinder flowpath 32 to the second pump flowpath 34 without passing through the second check valve 45 in the first position state P1. The first bypass port 16*d*, the first adjustment port 16*c*, the second pump port 16*e*, and the second adjustment port 16*g* are all cut off from communication with any port when the flowpath switching valve 16 is in the first position state P1.

When the hydraulic cylinder 14 is expanded, the first hydraulic pump 12 and the second hydraulic pump 13 are driven in a first discharge state and the flowpath switching valve 16 is set to the first position state P1. As a result, hydraulic fluid discharged from the first closed-circuit port 12*a* of the first hydraulic pump 12 and from the first open-circuit port 13*a* of the second hydraulic pump 13 passes through the first pump flowpath 33, the first check valve 44, and the first cylinder flowpath 31 to be supplied to the first chamber 14*c* of the hydraulic cylinder 14. The hydraulic fluid in the second chamber 14*d* of the hydraulic cylinder 14 passes through the second cylinder flowpath 32 and the second pump flowpath 34 to be recovered in the second closed-circuit port 12*b* of the first hydraulic pump 12. As a result, the hydraulic cylinder 14 expands.

The flowpath switching valve 16 allows communication between the second pump port 16*e* and the second cylinder port 16*f* and between the first cylinder port 16*b* and the first bypass port 16*d* in the second position state P2. Therefore, the flowpath switching valve 16 connects the first cylinder flowpath 31 to the first pump flowpath 33 without passing through the first check valve 44 and connects the second pump flowpath 34 to the second cylinder flowpath 32 via the second check valve 45 in the second position state P2. The first pump port 16*a*, the first adjustment port 16*c*, the second bypass port 16*h*, and the second adjustment port 16*g* are all cut off from communication with any port when the flowpath switching valve 16 is in the second position state P2.

When the hydraulic cylinder 14 is contracted, the first hydraulic pump 12 and the second hydraulic pump 13 are driven in a second discharge state and the flowpath switching valve 16 is set to the second position state P2. As a result, hydraulic fluid discharged from the second closed-circuit port 12*b* of the first hydraulic pump 12 passes through the second pump flowpath 34, the second check valve 45, and the second cylinder flowpath 32 to be supplied to the second chamber 14*d* of the hydraulic cylinder 14. The hydraulic fluid in the first chamber 14*c* of the hydraulic cylinder 14 passes through the first cylinder flowpath 31 and the first pump flowpath 33 to be recovered in the first closed-circuit port 12*a* of the first hydraulic pump 12 and in the first open-circuit port 13*a* of the second hydraulic pump 13. As a result, the hydraulic cylinder 14 contracts.

The flowpath switching valve 16 allows communication between the first bypass port 16*d* and the first adjustment port 16*c*, and between the second bypass port 16*h* and the second adjustment port 16*g* in the neutral position state Pn. Therefore, the flowpath switching valve 16 connects the first pump flowpath 33 to the adjustment flowpath 37 without passing through the first check valve 44, and connects the second pump flowpath 34 to the adjustment flowpath 37 without passing through the second check valve 45 in the neutral position state Pn. When the flowpath switching valve 16 is in the neutral position state Pn, the first pump port 16*a*, the first cylinder port 16*b*, the second pump port 16*e*, and the second cylinder port 16*f* are all cut off from communication with any port.

The hydraulic drive system 1 further includes an operating device 46. The operating device 46 includes an operating member 46*a* and an operation detecting unit 46*b*. The operating member 46*a* is operated by an operator to command various types of operations of the work machine. For example, if the hydraulic cylinder 14 is a boom cylinder for driving a boom, the operating member 46*a* is a boom operating lever for operating the boom. The operating member 46*a* may be operated in two directions: a direction for expanding the hydraulic cylinder 14 from the neutral position, and a direction for contracting the hydraulic cylinder 14 from the neutral position. The operation detecting unit 46*b* detects the operation amount and the operation direction of the operating member 46*a*. The operation detecting unit 46*b* is a sensor for detecting a position of the operating member 46*a* for example. When the operating member 46*a* is positioned in the neutral position, the operation amount of the operating member 46*a* is zero. Detection signals that indicate the operation amount and the operation direction of the operating member 46*a* are input from the operation detecting unit 46*b* to the pump controller 24.

The engine controller 22 controls the output of the engine 11 by controlling the fuel injection device 21. Engine output torque characteristics determined on the basis of a set target engine rotation speed and a work mode are mapped and stored in the engine controller 22. The engine output torque characteristics indicate the relationship between the output torque and the rotation speed of the engine 11. The engine controller 22 controls the output of the engine 11 on the basis of the engine output torque characteristics.

The pump controller 24 controls the flowpath switching valve 16 in accordance with the operating direction of the operating member 46*a*. If the operating member 46*a* is positioned in the neutral position, the pump controller 24 sets the flowpath switching valve 16 to the neutral position state Pn. If the operating member 46*a* is operated in the direction for expanding the hydraulic cylinder 14 from the neutral position, the pump controller 24 sets the flowpath switching valve 16 to the first position state P1. As a result, the first pump flowpath 33 and the first cylinder flowpath 31 are connected via the first check valve 44. Furthermore, the second pump flowpath 34 and the second cylinder flowpath 32 are connected without passing through the second check valve 45. As a result, hydraulic fluid is supplied to the first chamber 14*c* of the hydraulic cylinder 14 and the hydraulic cylinder 14 expands.

When the operating member 46*a* is operated in the direction for contracting the hydraulic cylinder 14 from the neutral position, the pump controller 24 sets the flowpath switching valve 16 to the second position state P2. As a result, the second pump flowpath 34 and the second cylinder flowpath 32 are connected via the second check valve 45. Further, the first pump flowpath 33 and the first cylinder flowpath 31 are connected without passing through the first check valve 44. As a result, hydraulic fluid is supplied to the second chamber 14*d* of the hydraulic cylinder 14 and the hydraulic cylinder 14 contracts.

The pump controller 24 controls the flow rate of the hydraulic fluid supplied to the hydraulic cylinder 14. The pump controller 24 includes a pump control unit 24*a* and a memory unit 24*b*. The pump control unit 24*a* may be realized by a calculation device, such as a CPU and the like. The memory unit 24*b* may be realized by a recording device such as a RAM, a ROM, a hard disk, or a flash memory and the like. The pump control unit 24*a* controls the displacement of the main pump 10 on the basis of the operating position of the operating member 46*a*. Specifically, the pump controller 24 calculates a target flow rate of the hydraulic fluid to be supplied to the hydraulic cylinder 14 in response to the operation amount of the operating member 46*a*. The pump control unit 24*a* calculates a target displacement (referred to below as "first target displacement") of the first pump-flow-rate control unit 25 and a target displacement (referred to below as "second target displacement") of the second pump-flow-rate control unit 26 on the basis of the target flow rate. When the hydraulic cylinder 14 is expanded, a total of the first target displacement and the second target displacement (referred to below as "total displacement") is a target displacement corresponding to the target flow rate. When the hydraulic cylinder 14 is contracted, the first target displacement is the target displacement corresponding to the target flow rate. The pump control unit 24*a* calculates the first target displacement and the second target displacement so that a ratio of the first target displacement with respect to the total displacement equals a ratio of the pressure receiving area of the second chamber 14*d* with respect to the pressure receiving area of the first chamber 14*c*. Specifically, the pump control unit 24*a* calculates the first target displacement and the second target displacement so that the ratio between the total displacement and the first target displacement equals the ratio between the pressure receiving area of the first chamber 14*c* and the pressure receiving area of the second chamber 14*d*. For example, when the ratio between the pressure receiving area of the first chamber 14*c* and the pressure receiving area of the second chamber 14*d* is 2:1, the pump control unit 24*a* calculates the first target displacement and the second target displacement so that the ratio between the total displacement and the first target displacement is 2:1. Specifically, the pump control unit 24*a* calculates the first target displacement and the second target displacement so that the ratio between the first target displacement and the second target displacement is 1:1. The pump control unit 24*a* sends a command signal corresponding to the first target displacement to the first pump-flow-rate control unit 25. The first pump-flow-rate control unit 25 controls the tilt angle of the first hydraulic pump 12 so that the displacement of the first hydraulic pump 12 becomes the first target displacement. The pump control unit 24*a* sends a command signal corresponding to the second target displacement to the second pump-flow-rate control unit 26. The second pump-flow-rate control unit 26 controls the tilt angle of the second hydraulic pump 13 so that the displacement of the second hydraulic pump 13 becomes the second target displacement. As a result, the pump control unit 24*a* controls the displacement of the first hydraulic pump 12 and the displacement of the second hydraulic pump 13 so that the ratio of the displacement of the first hydraulic pump 12 with respect to the total displacement of the first hydraulic pump 12 and the second hydraulic pump 13 equals the ratio of the pressure receiving area of the second chamber 14*d* with respect to the pressure receiving area of the first chamber 14*c*. The memory unit 24*b* stores information for controlling the first hydraulic pump 12 and the second hydraulic pump 13.

The shuttle valve 51 has a first input port 51*a*, a second input port 51*b*, a drain port 51*c*, a first pressure receiving section 51*d*, and a second pressure receiving section 51*e*. The first input port 51*a* is connected to the first flowpath 17. The second input port 51*b* is connected to the second flowpath 18. Specifically, the first input port 51*a* is connected to the first pump flowpath 33. The second input port 51*b* is connected to the second pump flowpath 34. The drain port 51*c* is connected to a drain flowpath 52. The drain flowpath 52 is connected to the charge flowpath 35 via the adjustment flowpath 37. The first pressure receiving section 51*d* is connected to the first flowpath 17 via a first pilot flowpath 53. As a result, the hydraulic pressure of the first flowpath 17 is applied to the first pressure receiving section 51*d*. A first throttle part 54 is disposed in the first pilot flowpath 53. The second pressure receiving section 51*e* is connected to the second flowpath 18 via a second pilot flowpath 55. As a result, the hydraulic pressure of the second flowpath 18 is applied to the second pressure receiving section 51*e*. A second throttle part 56 is disposed in the second pilot flowpath 55.

The shuttle valve 51 is switched between a first position state Q1, a second position state Q2, and a neutral position state Qn in accordance with the hydraulic pressure of the first flowpath 17 and the hydraulic pressure of the second flowpath 18. The shuttle valve 51 allows communication between the second input port 51*b* and the drain port 51*c* in the first position state Q1. As a result, the second flowpath 18 is connected to the drain flowpath 52. The shuttle valve 51 allows communication between the first input port 51*a* and the drain port 51*c* in the second position state Q2. As a result, the first flowpath 17 is connected to the drain flowpath 52. The shuttle valve 51 blocks communication between the first input port 51*a*, the second input port 51*b*, and the drain port 51*c* in the neutral position state Qn.

The shuttle valve 51 has a spool 57, a first elastic member 58, and a second elastic member 59. The first elastic member 58 presses the spool 57 from the first pressure receiving section 51*d* toward the second pressure receiving section 51*e*. The second elastic member 59 presses the spool 57 from the second pressure receiving section 51*e* toward the first pressure receiving section 51*d*. The first elastic member 58 is attached to the spool 57 in a state of being compressed more than its natural length. The first elastic member 58 is attached to press the spool 57 with a first attachment load when the spool 57 is in a neutral position. The second elastic member 59 is attached to the spool 57 in a state of being compressed more than its natural length. The second elastic member 59 is attached to press the spool 57 with a second attachment load when the spool 57 is in a neutral position.

The ratio between the pressure receiving area of a first pressure section 51*d* and the pressure receiving area of a second pressure section 51*e* is equal to the ratio between the pressure receiving area of the first chamber 14*c* and the pressure receiving area of the second chamber 14*d*. For example, when the ratio between the pressure receiving area of the first chamber 14*c* and the pressure receiving area of the second chamber 14*d* is 2:1, the ratio between the pressure receiving area of a first pressure section 51*d* and the pressure receiving area of a second pressure section 51*e* is 2:1. A ratio between an elastic constant of the first elastic member 58 and an elastic constant of the second elastic member 59 has an inverse relationship with the ratio between the pressure receiving area of the first pressure receiving section 51*d* and the pressure receiving area of the second pressure receiving section 51*e*. In other words, the ratio between an elastic constant of the first elastic member 58 and the elastic constant of the second elastic member 59 has an inverse relationship with the ratio between the pressure receiving area of the first chamber 14*c* and the pressure receiving area of the second chamber 14*d*. For example, the ratio between an elastic constant of the first elastic member 58 and the elastic constant of the second elastic member 59 is 1:2 when the ratio between the pressure receiving area of the first chamber 14*c* and the pressure receiving area of the second chamber 14*d* is 2:1. The ratio between the first attachment load and the second attachment load has an inverse relationship with the ratio between the pressure receiving area of the first pressure receiving section 51*d* and the pressure receiving area of the second pressure receiving section 51*e*. In other words, the ratio between the first attachment load and the second attachment load has an inverse relationship with the ratio between the pressure receiving area of the first chamber 14*c* and the pressure receiving area of the second chamber 14*d*. For example, the ratio between the first attachment load and the second attachment load is 1:2 when the ratio between the pressure receiving area of the first chamber 14*c* and the pressure receiving area of the second chamber 14*d* is 2:1.

When a force applied to the first pressure receiving section 51*d* due to the hydraulic pressure of the first flowpath 17 is greater than a force applied to the second pressure receiving section 51*e* due to the hydraulic pressure of the second flowpath 18, the shuttle valve 51 enters the first position state Q1. As a result, the second flowpath 18 is connected to the drain flowpath 52. Consequently, a portion of the hydraulic fluid in the second flowpath 18 flows to the charge flowpath 35 via the drain flowpath 52. When a force applied to the second pressure receiving section 51*e* due to the hydraulic pressure of the second flowpath 18 is greater than a force applied to the first pressure receiving section 51*d* due to the hydraulic pressure of the first flowpath 17, the shuttle valve 51 enters the second position state Q2. As a result, the first flowpath 17 is connected to the drain flowpath 52. Consequently, a portion of the hydraulic fluid in the first flowpath 17 flows to the charge flowpath 35 via the drain flowpath 52.

Figure 2:
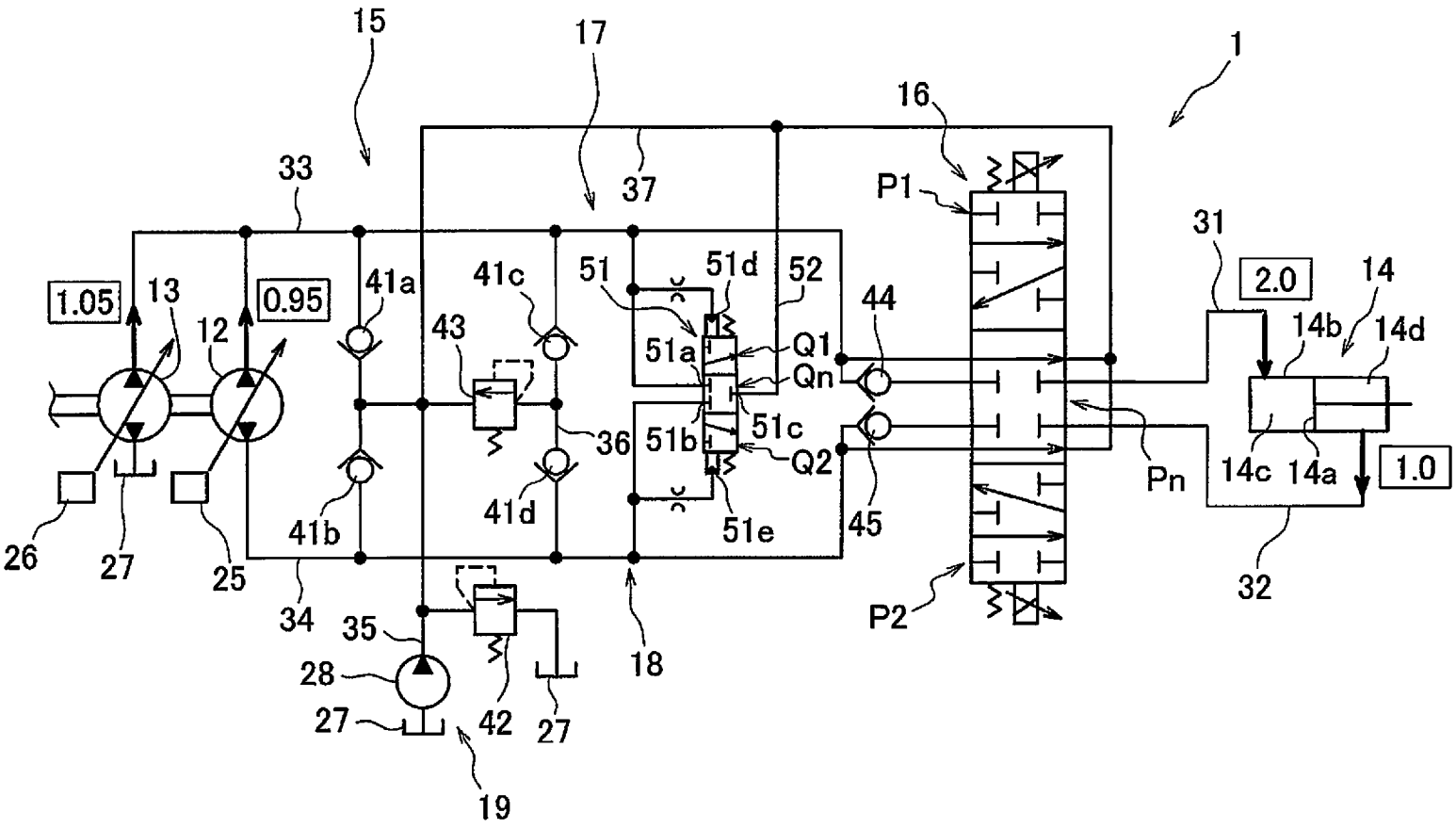
FIG. 2 illustrates an example of a hydraulic fluid flow rate in a hydraulic drive system when a hydraulic cylinder is expanded.
Figure 3:
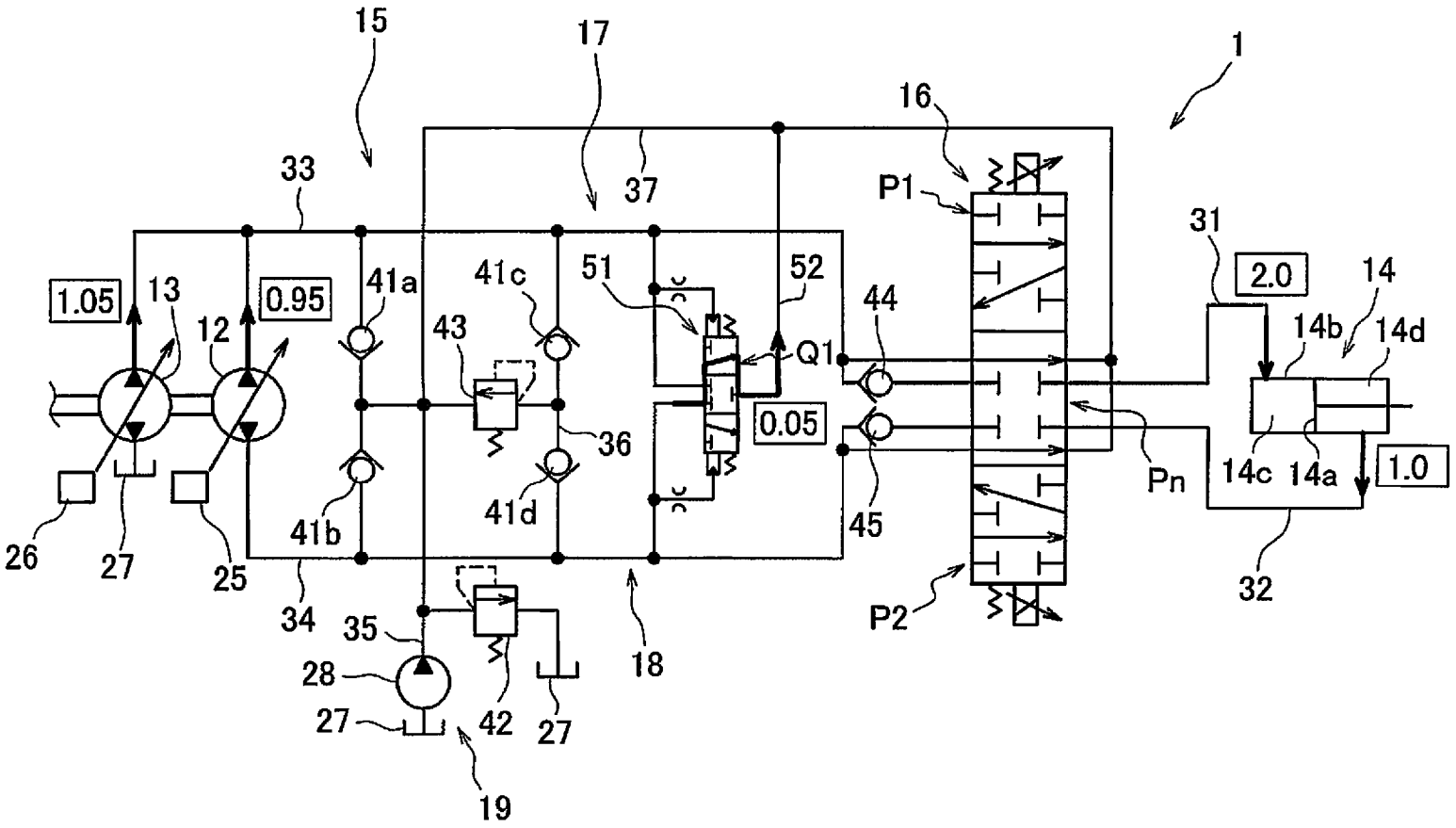
FIG. 3 illustrates an example of a hydraulic fluid flow rate in a hydraulic drive system when a hydraulic cylinder is expanded.

FIG. 2 illustrates an example of a hydraulic fluid flow rate in the hydraulic drive system 1 when the hydraulic cylinder 14 is expanded to, for example, raise the boom of a hydraulic excavator. When the target flow rate of the hydraulic cylinder 14 is "2.0," the pump control unit 24*a* sets both the first target displacement and the second target displacement to "1.0." However, the actual displacement of the first hydraulic pump 12 is "0.95" and the actual displacement of the second hydraulic pump 13 is "1.05." At this time, while hydraulic fluid at the flow rate of "1.0" is exhausted from the second chamber 14*d* of the hydraulic cylinder 14, the first hydraulic pump 12 is only able to suck in hydraulic fluid at the flow rate of "0.95" and thus a hydraulic fluid flow rate with an excess of "0.05" is produced. However, the ratio between the pressure receiving area of the first pressure section 51*d* and the pressure receiving area of the second pressure section 51*e* is equal to the ratio between the pressure receiving area of the first chamber 14*c* and the pressure receiving area of the second chamber 14*d* in the shuttle valve 51. The equation $(p1+\alpha)\times S1>P2\times S2$ is derived, where the hydraulic pressure of the first chamber 14*c* is P1 and the hydraulic pressure of the second chamber 14*d* is P2 when an external load acting on the cylinder rod 14*a* is ignored, and the hydraulic pressure of the first chamber 14*c* for resisting an external load acting on the cylinder rod 14*a* is a, the pressure receiving area of the first pressure receiving section 51*d* is S1, and the pressure receiving area of the second pressure receiving section 51*e* is S2. Therefore, as illustrated in FIG. 3, the second input port 51*b* and the drain port 51*c* are connected since the shuttle valve 51 is switched to the first position state Q1. As a result, the second pump flowpath 34 is connected to the drain flowpath 52 and the excess hydraulic fluid at the flow rate of "0.05" is exhausted to the charge circuit 35. Consequently, an unnecessary rise in the hydraulic pressure of the second flowpath 18 is suppressed. Conversely, if the actual displacement of the first hydraulic pump 12 is "1.05" and the displacement of the second hydraulic pump 13 is "0.95," the first hydraulic pump 12 sucks in hydraulic fluid at the flow rate of "1.05" although hydraulic fluid at the flow rate of "1.0" is exhausted from the second chamber 14*d*. The missing amount of hydraulic fluid at the flow rate "0.05" is sucked in from the charge flowpath 35 via the check valve 41*b* and/or the shuttle valve 51 in the first position state Q1.

Figure 4:
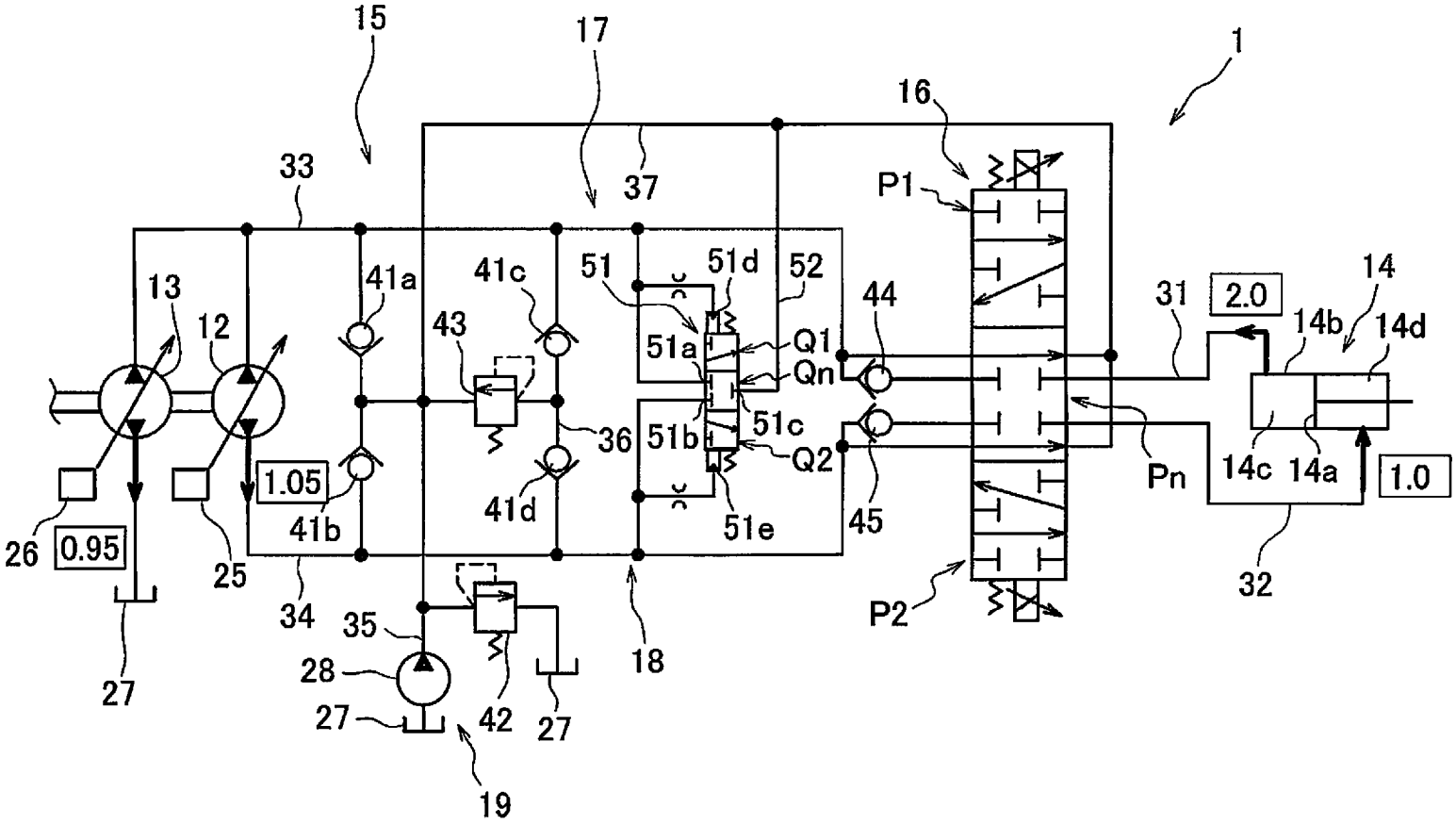
FIG. 4 illustrates an example of a hydraulic fluid flow rate in a hydraulic drive system when a hydraulic cylinder is contracted.
Figure 5:
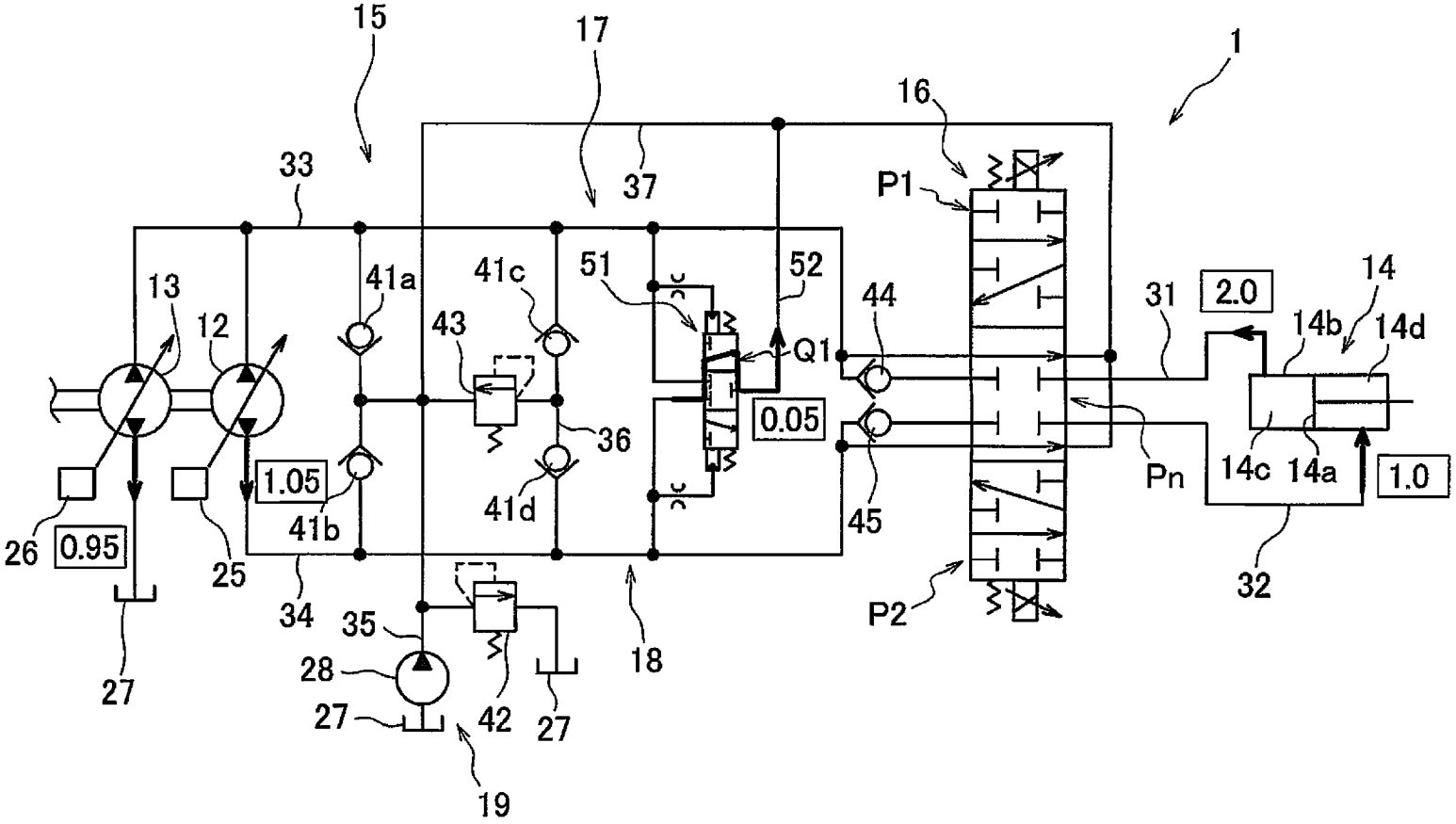
FIG. 5 illustrates an example of a hydraulic fluid flow rate in a hydraulic drive system when a hydraulic cylinder is contracted.

FIG. 4 illustrates an example of a hydraulic fluid flow rate in the hydraulic drive system 1 when the hydraulic cylinder 14 is contracted to, for example, lower the boom of a hydraulic excavator. When the target flow rate of the hydraulic cylinder 14 is "1.0," the pump control unit 24*a* sets both the first target displacement and the second target displacement to "1.0." However, the actual displacement of the first hydraulic pump 12 is "1.05" and the actual displacement of the second hydraulic pump 13 is "0.95." At this time, while the first hydraulic pump 12 discharges hydraulic fluid at the flow rate of "1.05," the second chamber 14*d* of the hydraulic cylinder 14 is only able to suck in hydraulic fluid at the flow rate of "1.0" because hydraulic fluid at the flow rate of "2.0" is exhausted from the first chamber 14*c* of the hydraulic cylinder 14. As a result, the hydraulic fluid of the flow rate with an excess of "0.05" is produced. However, the ratio between the pressure receiving area of the first pressure section 51*d* and the pressure receiving area of the second pressure section 51*e* is equal to the ratio between the pressure receiving area of the first chamber 14*c* and the pressure receiving area of the second chamber 14*d* in the shuttle valve 51. The equation $(P1+\alpha)\times S1>P2\times S2$ is derived, where the hydraulic pressure of the first chamber 14*c* is P1 and the hydraulic pressure of the second chamber 14*d* is P2 when an external load acting on the cylinder rod 14*a* is ignored, and the hydraulic pressure of the first chamber 14*c* for resisting an external load acting on the cylinder rod 14*a* is $\alpha$, the pressure receiving area of the first pressure receiving section 51*d* is S1, and the pressure receiving area of the second pressure receiving section 51*e* is S2. Therefore, as illustrated in FIG. 5, the second input port 51*b* and the drain port 51*c* are connected since the shuttle valve 51 is switched to the first position state Q1. As a result, the second pump flowpath 34 is connected to the drain flowpath 52 and the excess hydraulic fluid at the flow rate of "0.05" is exhausted to the charge circuit 35. Consequently, an unnecessary rise in the hydraulic pressure of the second flowpath 18 is suppressed. Conversely, when the actual displacement of the first hydraulic pump 12 is "0.95" and the displacement of the second hydraulic pump 13 is "1.05," hydraulic fluid at the flow rate of "2.0" is exhausted from the first chamber 14*c* because the first hydraulic pump 12 and the second hydraulic pump 13 suck in hydraulic fluid at the flow rate of "2.0." As a result, hydraulic fluid at the flow rate of "1.0" is sucked into the second chamber 14*d*. Thus, the missing amount of hydraulic fluid at the flow rate of "0.05" is sucked in from the charge flowpath 35 via the check valve 41*b* and/or the shuttle valve 51 in the first position state Q1.

Figure 6:
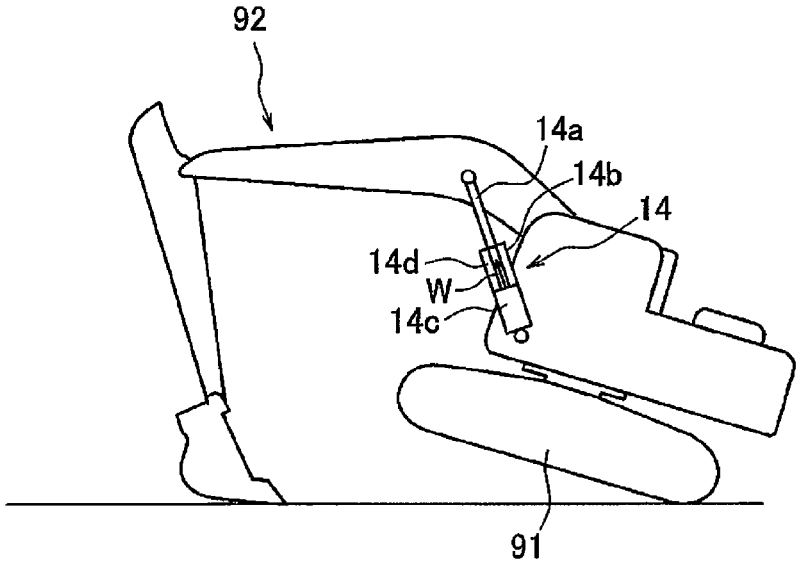
FIG. 6 is a schematic view of an example of a work orientation of a hydraulic excavator to which the hydraulic drive system according to an exemplary embodiment of the present invention is applied.

As illustrated in FIG. 6, a hydraulic excavator may use the rear part of a crawler belt 91 and a working implement 92 to move into an orientation (referred to below as a "jack-up orientation") in which the front part of the crawler belt 91 is lifted up from the ground surface. When the abovementioned hydraulic cylinder 14 is a boom cylinder, hydraulic pressure for supporting a weight W of the vehicle is generated in the second chamber 14*d* of the cylinder tube 14*b* in the jack-up orientation. Therefore, the equation $P1\times S1<(P2+\alpha)\times S2$ is derived when supplying hydraulic fluid to the first chamber 14*c* and exhausting hydraulic fluid from the second chamber 14*d*, where the hydraulic pressure of the second chamber 14*d* for supporting the weight W of the vehicle is $\alpha$. As a result, the shuttle valve 51 is switched to the second position state Q2 and the first input port 51*a* is connected to the drain port 51*c*. Thus, the first pump flowpath 33 is connected to the drain flowpath 52. Further, the equation $P1\times S1<(P2+\alpha)\times S2$ is derived when supplying hydraulic fluid to the second chamber 14*d* and exhausting hydraulic fluid from the first chamber 14*c*. As a result, the shuttle valve 51 is switched to the second position state Q2 and the first input port 51*a* is connected to the drain port 51*c*. Thus, the first pump flowpath 33 is connected to the drain flowpath 52. Therefore, the first pump flowpath 33 is connected to the drain flowpath 52 when the cylinder rod 14*a* of the hydraulic cylinder 14 expands during the jack-up orientation. Because the excess hydraulic fluid is exhausted to the charge circuit 35, an unnecessary rise in the hydraulic pressure of the first flowpath 17 is suppressed. The first pump flowpath 33 is connected to the drain flowpath 52 when the cylinder rod 14*a* of the hydraulic cylinder 14 contracts during the jack-up orientation. Because the excess hydraulic fluid is exhausted to the charge circuit 35, an unnecessary rise in the hydraulic pressure of the first flowpath 17 is suppressed.

As described above, the shuttle valve 51 in the hydraulic drive system 1 according to the present exemplary embodiment connects the flowpath connected to either the first chamber 14*c* or the second chamber 14*d* that is not subject to an external force, to the charge circuit 35. Therefore, because the flowpath connected to either the first chamber 14*c* or the second chamber 14*d* when the hydraulic cylinder 14 is not subject to an external force is connected to the charge circuit 35 via the shuttle valve 51, a rise in the hydraulic pressure is suppressed even when there is a deviation in the control of the displacements of the hydraulic pumps 12 and 13. In this way, the rise in hydraulic pressure may be suppressed even when a deviation in the control of the displacements of the hydraulic pumps occurs in a hydraulic circuit in which a closed circuit is configured between the hydraulic pumps 12 and 13 and the hydraulic cylinder 14 in the hydraulic drive system 1 according to the present exemplary embodiment.

Generally, the relationship between a pressure (referred to below as "switching pressure") P applied to the pressure receiving section of a spool in a shuttle valve and a stroke amount x from the neutral position of the spool, is expressed with the following equation 1.

$$PS=F0+kx \qquad \text{Equation 1}$$

where, S is the pressure receiving area of the pressure receiving section, F0 is the attachment load of an elastic member, and k is the elastic constant of the elastic member. A modification of the equation 1 is expressed with the following equation 2.

$$P=\frac{F0}{S}+\frac{k}{S}x \qquad \text{Equation 2}$$

Figure 7:
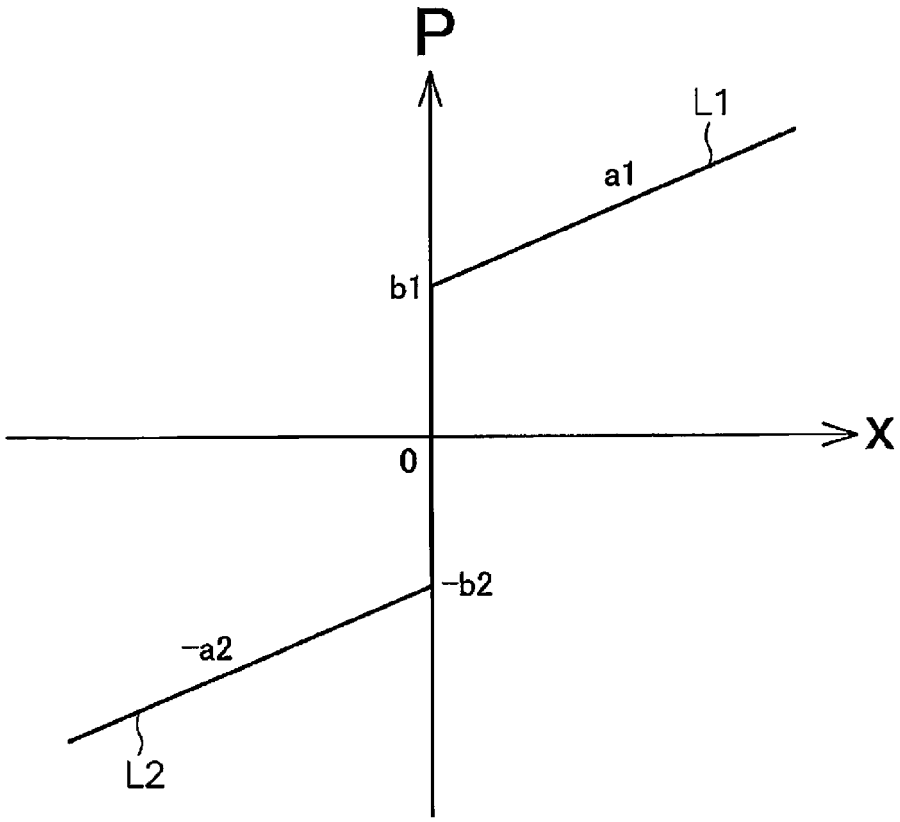
FIG. 7 illustrates switching characteristics of a shuttle valve.

Therefore, the switching characteristics of the shuttle valve 51 are expressed by L1 and L2 in FIG. 7. The switching characteristics L1 and L2 illustrate the relationship between the switching pressure P and the stroke amount x. In FIG. 7, the stroke amount x is 0 when the shuttle valve 51 is in the neutral position state Qn. Further, the stroke amount takes on a positive value when the shuttle valve 51 enters the first position state Q1, and the stroke amount takes on a negative value when the shuttle valve 51 enters the second position state Q2. In this case, the switching characteristic L1 when the shuttle valve 51 is in the first position state Q1 is expressed by the following equation 3. The switching characteristic L2 when the shuttle valve 51 is in the second position state Q2 is expressed by the following equation 4.

$$P=\frac{F1}{S1}+\frac{k1}{S1}x \qquad \text{Equation 3}$$

$$P=-\frac{F2}{S2}-\frac{k2}{S2}x \qquad \text{Equation 4}$$

F1 is the first attachment load in Equation 3, S1 is the pressure receiving area of the first pressure receiving section 51*d*, and k1 is the elastic constant of the first elastic member 58. F2 in equation 4 is the second attachment load, S2 is the pressure receiving area of the second pressure receiving section 51*e*, and k2 is the elastic constant of the second elastic member.

As described above, the ratio between the elastic constant k1 of the first elastic member 58 and the elastic constant k2 of the second elastic member 59 has an inverse relationship with the ratio between the pressure receiving area S1 of the first pressure receiving section 51*d* and the pressure receiving area S2 of the second pressure receiving section 51*e*. Therefore, an absolute value a1 of the slope of the switching characteristic L1 when the shuttle valve 51 is in the first position state Q1 is equal to an absolute value a2 of the slope of the switching characteristic L2 when the shuttle valve 51 is in the second position state Q2. The ratio between the first attachment load F1 and the second attachment load F2 has an inverse relationship with the ratio between the pressure receiving area S1 of the first pressure receiving section 51*d* and the pressure receiving area S2 of the second pressure receiving section 51*e*. Therefore, an absolute value b1 of the intercept of the switching characteristic L1 when the shuttle valve 51 is in the first position state Q1 is equal to an absolute value b2 of the intercept of the switching characteristic L2 when the shuttle valve 51 is in the second position state Q2. Therefore, the switching characteristics of the shuttle valve 51 are the same when the spool 57 moves from the neutral position to the first pressure receiving section 51*d* side and when the spool 57 moves from the neutral position to the second pressure receiving section 51*e* side. As a result, the same switching characteristics of the shuttle valve 51 may be obtained when reducing the hydraulic pressure of the first flowpath 17 and when reducing the hydraulic pressure of the second flowpath 18.

When the operating member 46*a* is in the neutral position, the flowpath switching valve 16 is set to the neutral position state Pn. As a result, the first flowpath 17 and the second flowpath 18 are connected to the charge flowpath 35 via the adjustment flowpath 37. As a result, a rise in the hydraulic pressure of the first flowpath 17 and/or the second flowpath 18 may be suppressed even if the displacement of the first hydraulic pump 12 and/or the second hydraulic pump 13 is not zero when the operating member 46*a* is in the neutral position. Specifically, a rise in the hydraulic pressure of the first flowpath 17 and/or the second flowpath 18 may be suppressed even if the tilt angle of the first hydraulic pump 12 and/or the second hydraulic pump 13 deviates from the angle corresponding to the neutral position when the operating member 46*a* is in the neutral position.

Although an exemplary embodiment of the present invention has been described, the present invention is not limited to the above exemplary embodiment and various modifications may be made within the scope of the invention.

Figure 8:
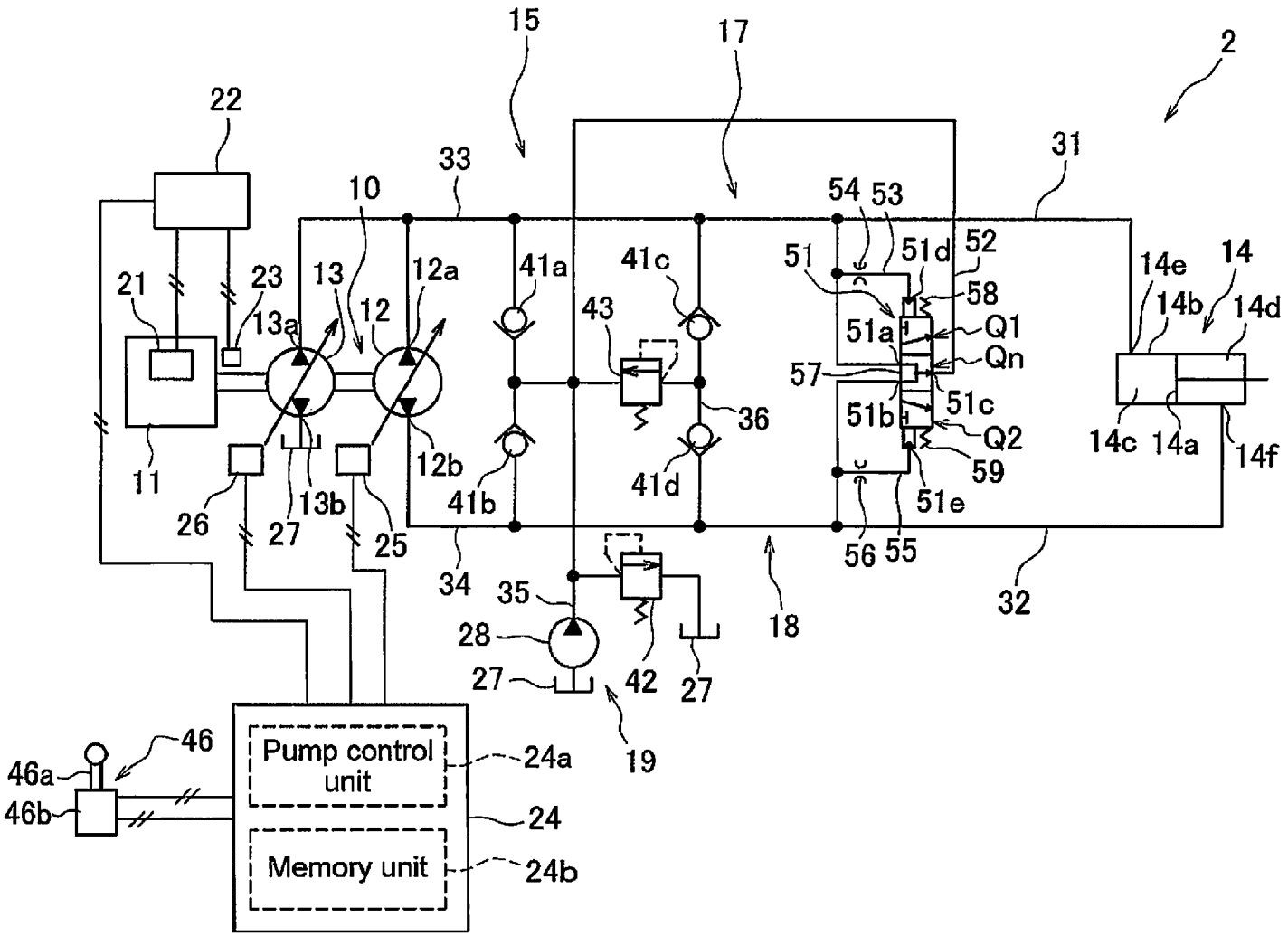
FIG. 8 is a block diagram of a configuration of a hydraulic drive system according to a first modified example of the present invention.

FIG. 8 is a block diagram of a configuration of a hydraulic drive system 2 according to a first modified example of the present invention. The flowpath switching valve 16 is omitted from the abovementioned hydraulic drive system 1 in the hydraulic drive system 2 according to the first modified example. Moreover, the shuttle valve 51 allows communication between the first input port 51*a* and the second input port 51*b*, and the drain port 51*c* in the neutral position state Qn. Other configurations are the same as those of the abovementioned hydraulic drive system 1. When the shuttle valve 51 is in the neutral position state Qn in the hydraulic drive system 2 according to the first modified example, the first flowpath 17 and the second flowpath 18 are connected to the charge flowpath 35 via the drain flowpath 52. As a result, a rise in the hydraulic pressure of the first flowpath 17 and/or the second flowpath 18 may be suppressed even when the displacement of the first hydraulic pump 12 and/or the second hydraulic pump 13 is zero when the operating member 46*a* is in the neutral position. Specifically, a rise in the hydraulic pressure of the first flowpath 17 and/or the second flowpath 18 may be suppressed even if the tilt angle of the first hydraulic pump 12 and/or the second hydraulic pump 13 deviates from the angle corresponding to the neutral position when the operating member 46*a* is in the neutral position.

Figure 9:
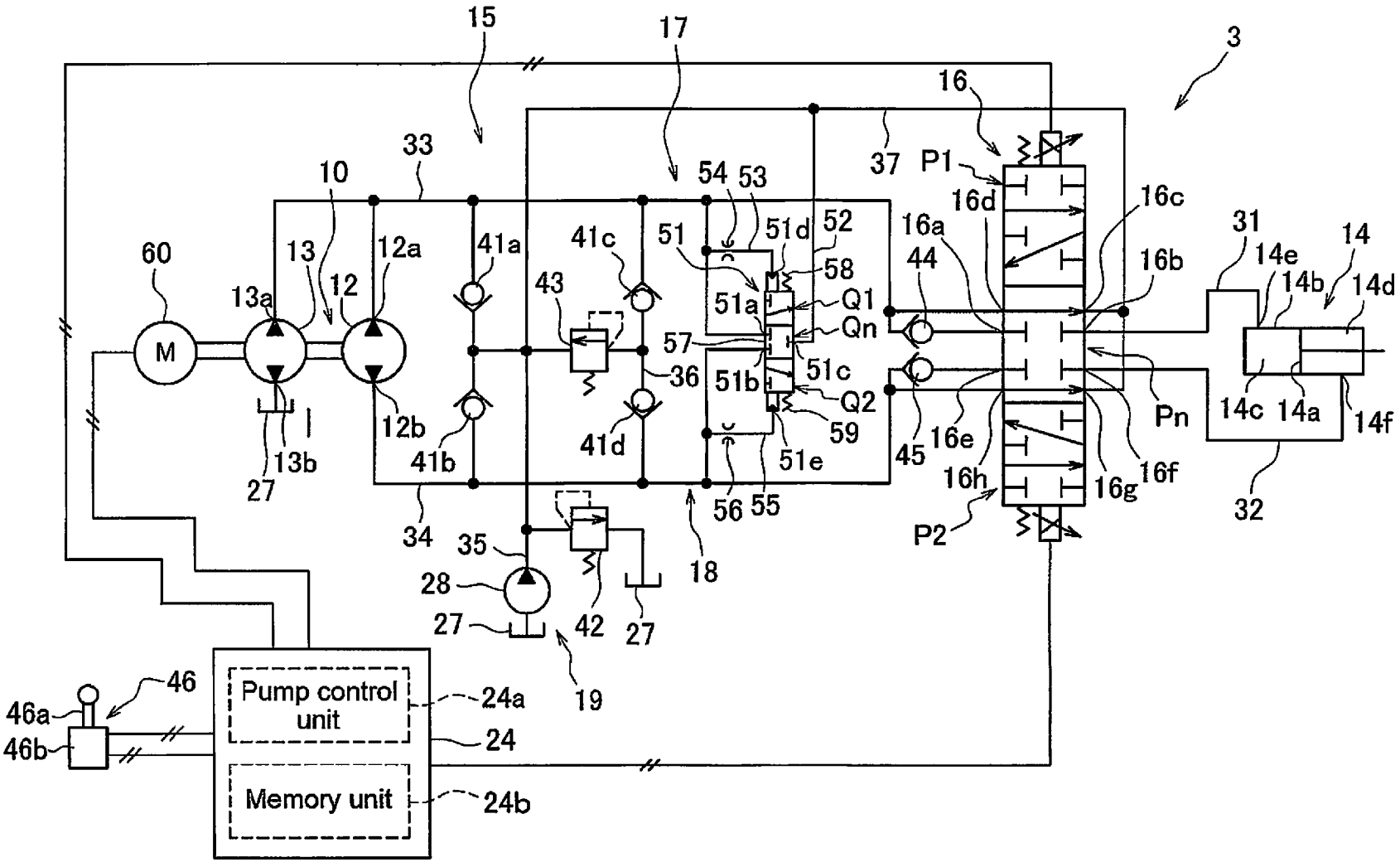
FIG. 9 is a block diagram of a configuration of a hydraulic drive system according to a second modified example of the present invention.
Figure 10:
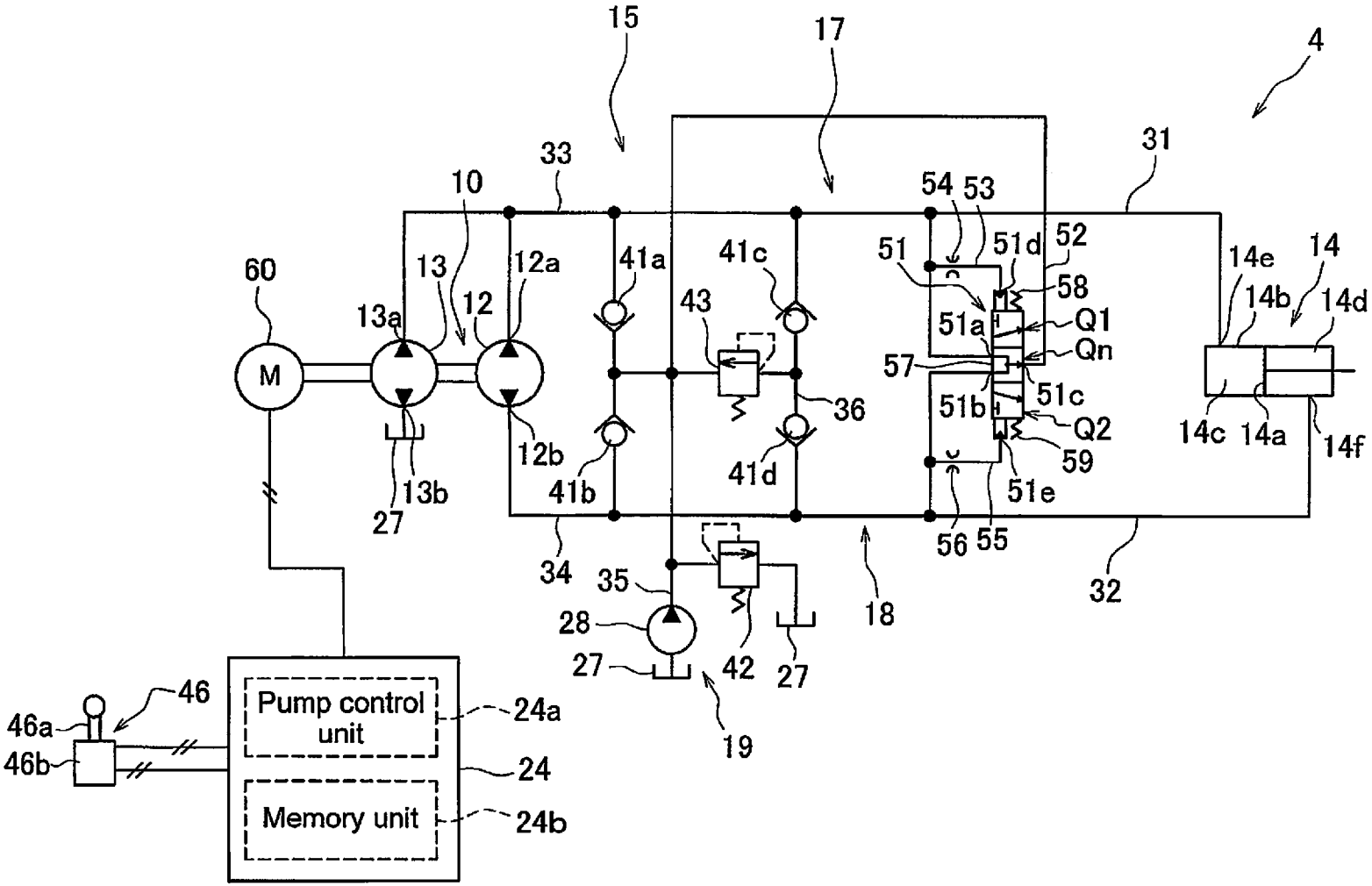
FIG. 10 is a block diagram of a configuration of a hydraulic drive system according to a third modified example of the present invention.

The pump-flow-rate control units 25 and 26 control the displacements of the hydraulic pumps 12 and 13 by controlling the tilt angles of the hydraulic pumps 12 and 13 in the hydraulic drive system 1 according to the above exemplary embodiment. Specifically, the pump-flow-rate control units 25 and 26 control the discharge flow rate of the hydraulic pumps 12 and 13 by controlling the tilt angles of the hydraulic pumps 12 and 13. However, the discharge flow rates of the hydraulic pumps 12 and 13 may be controlled by controlling the rotation speeds of the hydraulic pumps 12 and 13. For example, an electric motor may be used as a driving source. FIG. 9 is a block diagram of a configuration of a hydraulic drive system 3 according to a second modified example. An electric motor 60 is provided in place of the engine 11 in the hydraulic drive system 1 of the abovementioned embodiment in the hydraulic drive system 3 according to the second modified example. The hydraulic pumps 12 and 13 are fixed displacement hydraulic pumps. In this case, the pump controller 24 controls the rotation speeds of the hydraulic pumps 12 and 13 so that the rotation speeds of the hydraulic pumps 12 and 13 match a target rotation speed corresponding to the operation amount of the operating member 46*a* by controlling the rotation speed of the electric motor 60. Alternatively, the electric motor 60 may be used as a driving source in place of the engine 11 in the hydraulic drive system 2 according to the first modified example as in a hydraulic drive system 4 according to a third modified example illustrated in FIG. 10. When the volume efficiencies of the first hydraulic pump 12 and the second hydraulic pump 13 become different due to aging and the like in the hydraulic drive systems 3 and 4, it is possible that the difference between the discharge flow rate of the first hydraulic pump 12 and the discharge flow rate of the second hydraulic pump 13 may increase. However, even in this case, an unnecessary rise in the hydraulic pressure of the flowpath that does not have an external load acting thereon among the first flowpath 17 and the second flowpath 18 is suppressed in the hydraulic drive systems 3 and 4.

Figure 11:
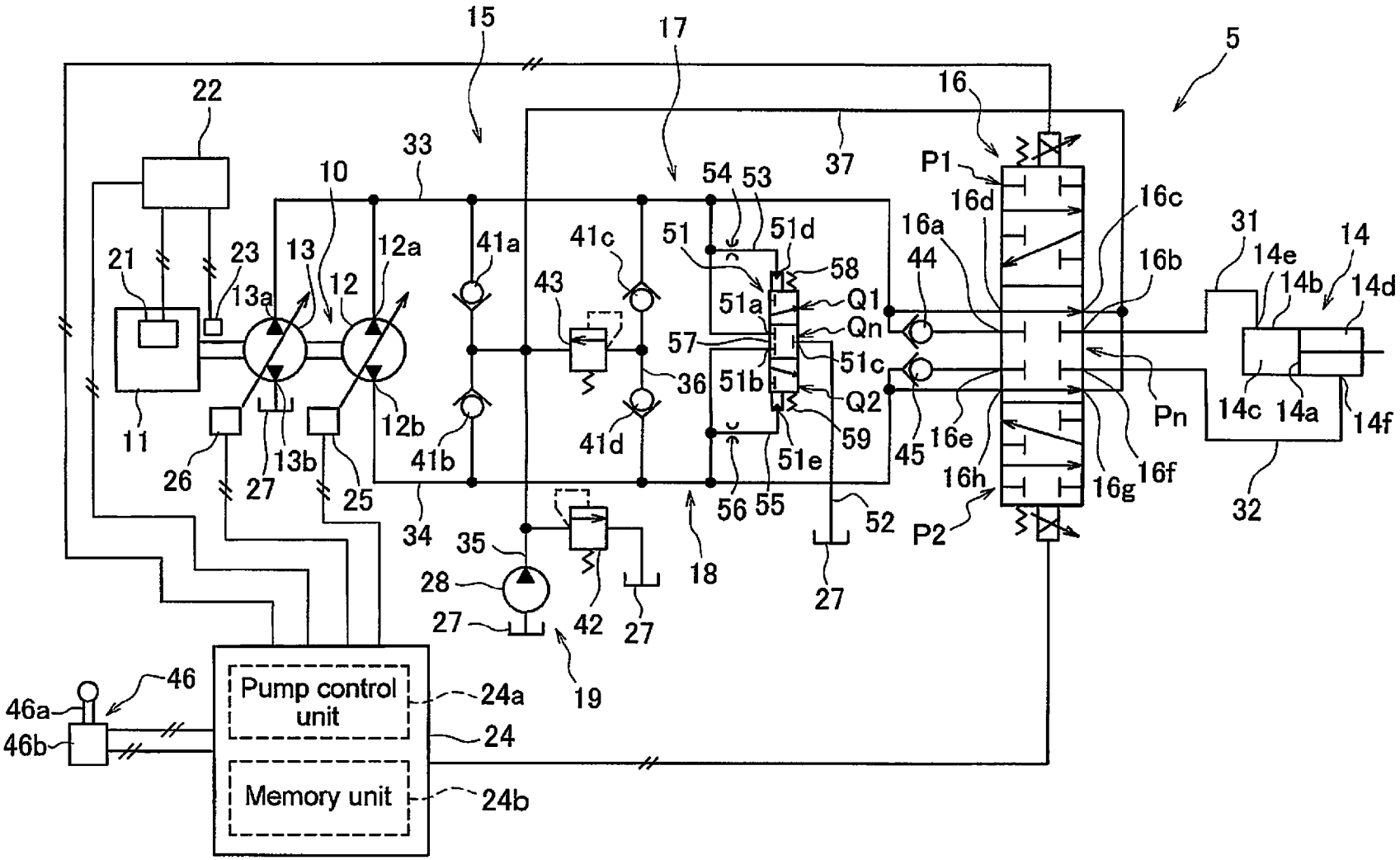
FIG. 11 is a block diagram of a configuration of a hydraulic drive system according to a fourth modified example of the present invention.
Figure 12:
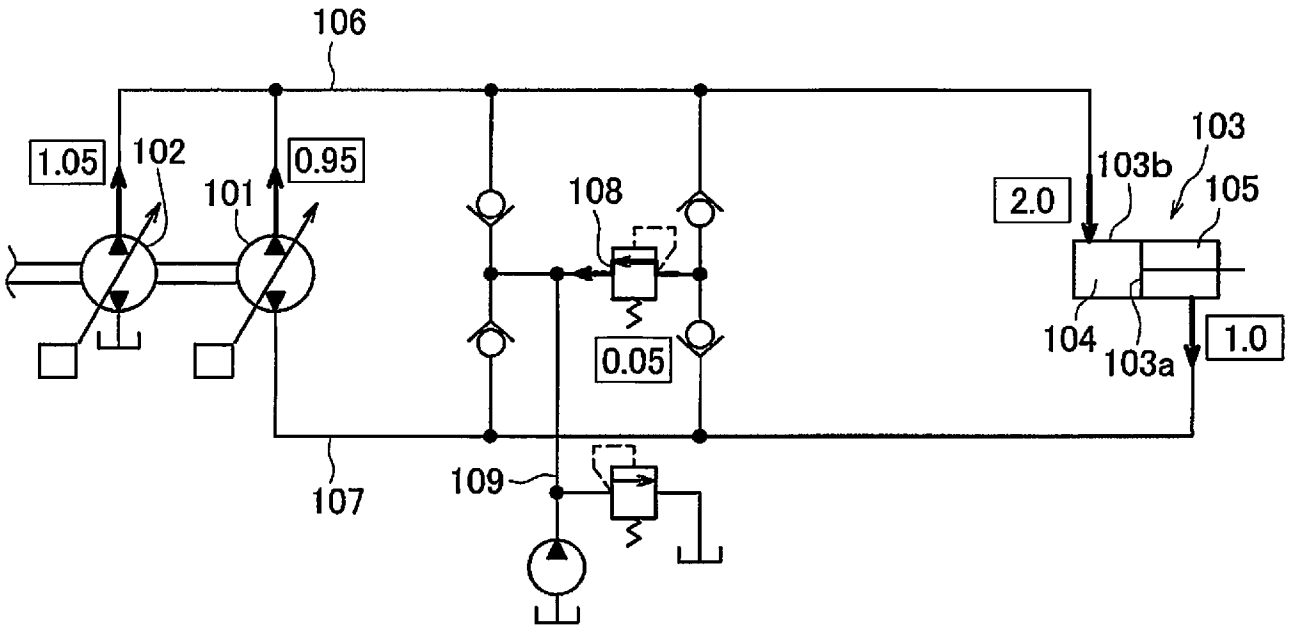
FIG. 12 (PRIOR ART)
FIG. 12 is a block diagram of a configuration of a conventional hydraulic drive system in which a hydraulic cylinder is expanding.
Figure 13:
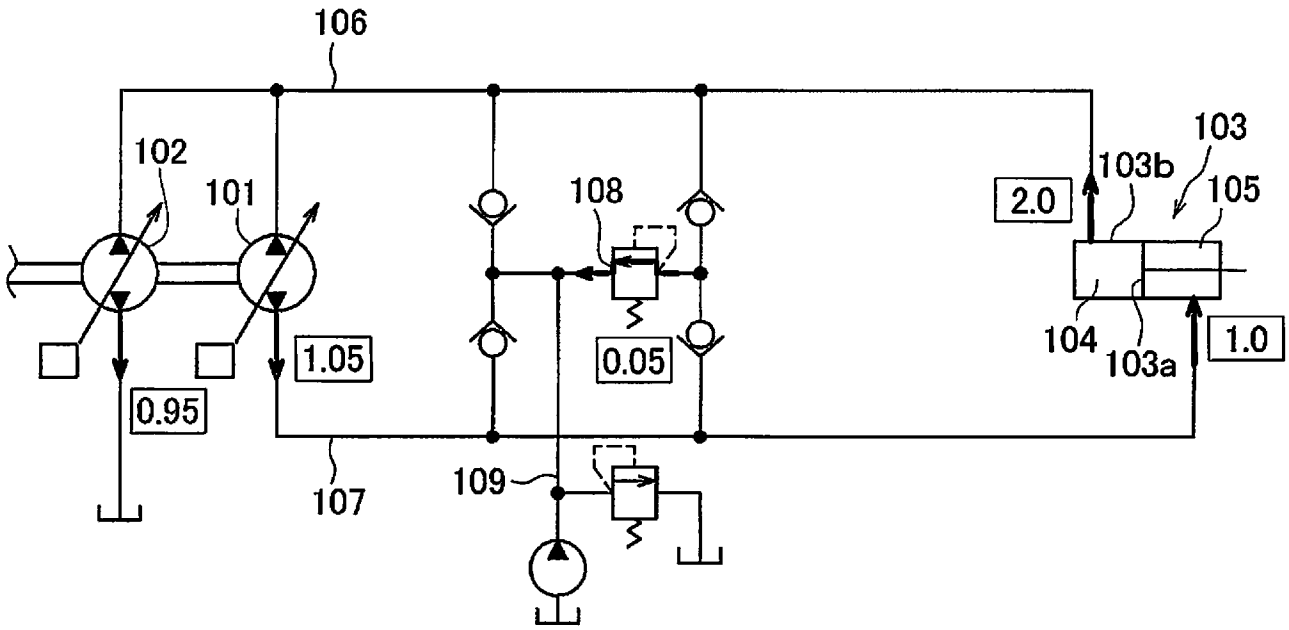
FIG. 13 (PRIOR ART)
FIG. 13 is a block diagram of a configuration of a conventional hydraulic drive system in which a hydraulic cylinder is contracting.

The drain flowpath 52 is connected to the charge circuit 19 in the hydraulic drive systems 1 to 4 according to the above embodiment and the first to third modified examples. However, the drain flowpath 52 may be connected to a hydraulic fluid tank. FIG. 11 is a block diagram of a configuration of a hydraulic drive system 5 according to a fourth modified example. The drain flowpath 52 is connected to the hydraulic fluid tank 27 in the hydraulic drive system 5 according to the fourth modified example. Other configurations are the same as those of the abovementioned hydraulic drive system 1.

While the ratio between the pressure receiving area of the first chamber 14*c* and the pressure receiving area of the second chamber 14*d* is exemplified as 2:1 in the above exemplary embodiment, the ratio between pressure receiving area of the first chamber 14*c* and the pressure receiving area of the second chamber 14*d* is not limited to 2:1 and may be another value.

The ratio between the elastic constant of the first elastic member 58 and the elastic constant of the second elastic member 59 has an inverse relationship with the ratio between the pressure receiving area of the first pressure receiving section 51*d* and the pressure receiving area of the second pressure receiving section 51*e*. However, the ratio between the elastic constant of the first elastic member 58 and the elastic constant of the second elastic member 59 is not limited to the above inverse relationship. However, the above inverse relationship is desired from the point of view of approximating the switching characteristics of the shuttle valve 51 when reducing the hydraulic pressure of the first flowpath 17 with the switching characteristics of the shuttle valve 51 when reducing the hydraulic pressure of the second flowpath 18.

The ratio between the first attachment load and the second attachment load has an inverse relationship with the ratio between the pressure receiving area of the first pressure receiving section 51*d* and the pressure receiving area of the second pressure receiving section 51*e* in the above exemplary embodiment. However, the ratio between the first attachment load and the second attachment load is not limited to the relationship of the ratio as described above. However, the above inverse relationship is desired from the point of view of approximating the switching characteristics of the shuttle valve 51 when reducing the hydraulic pressure of the first flowpath 17 with the switching characteristics of the shuttle valve 51 when reducing the hydraulic pressure of the second flowpath 18.

According to exemplary embodiments of the present invention, a hydraulic drive system suppresses a rise in hydraulic pressure even when a deviation in discharge flow rate control between hydraulic pumps occurs in a hydraulic circuit in which a closed circuit is configured between a hydraulic pump and a hydraulic cylinder.

What is claimed is:

1. A hydraulic drive system, comprising:

a first hydraulic pump having a first closed-circuit port and a second closed-circuit port, the first hydraulic pump being switchable between a first discharge state in which hydraulic fluid is sucked in from the second closed-circuit port and hydraulic fluid is discharged from the first closed-circuit port, and a second discharge state in which hydraulic fluid is sucked in from the first closed-circuit port and hydraulic fluid is discharged from the second closed-circuit port;

a hydraulic cylinder having a cylinder rod and a cylinder tube, the inside of the cylinder tube being partitioned into a first chamber and a second chamber by the cylinder rod, a pressure receiving area on the first chamber side of the cylinder rod being larger than a pressure receiving area on the second chamber side, the hydraulic cylinder expanding due to hydraulic fluid being supplied to the first chamber and hydraulic fluid being exhausted from the second chamber, the hydraulic cylinder contracting due to hydraulic fluid being supplied to the second chamber and hydraulic fluid being exhausted from the first chamber;

a hydraulic fluid flowpath having a first flowpath connecting the first closed-circuit port and the first chamber, and a second flowpath connecting the second closed-circuit port and the second chamber;

a hydraulic fluid tank configured to store hydraulic fluid;

a second hydraulic pump having a first open-circuit port connected to the first flowpath and a second open-circuit port connected to the hydraulic fluid tank, the second hydraulic pump being switchable between a first discharge state in which hydraulic fluid is sucked in from the second open-circuit port and hydraulic fluid is discharged from the first open-circuit port and a second discharge state in which hydraulic fluid is sucked in from the first open-circuit port and hydraulic fluid is discharged from the second open-circuit port;

a charge circuit having a charge flowpath connected to the hydraulic fluid flowpath, and a charge pump configured to discharge hydraulic fluid to the charge flowpath, the charge circuit replenishing hydraulic fluid to the hydraulic fluid flowpath when a hydraulic pressure of the hydraulic fluid flowpath is smaller than a hydraulic pressure of the charge flowpath;

a pump control unit configured to set a first target displacement for controlling a discharge flow rate of the first hydraulic pump and a second target displacement for controlling a discharge flow rate of the second hydraulic pump so that a ratio of the first target displacement with respect to a total of the first target displacement and the second target displacement equals a ratio of a pressure receiving area of the second chamber with respect to a pressure receiving area of the first chamber;

a shuttle valve having a first input port connected to the first flowpath, a second input port connected to the second flowpath, a drain port connected to the hydraulic fluid tank or to the charge flowpath, a first pressure receiving section to which the hydraulic pressure of the first flowpath is applied, and a second pressure receiving section to which the hydraulic pressure of the second flowpath is applied, the shuttle valve being configured to enter a first position state that allows communication between the second input port and the drain port when a force applied to the first pressure receiving section by the hydraulic pressure of the first flowpath is greater than a force applied to the second pressure receiving section by the hydraulic pressure of the second flowpath, the shuttle valve being configured to enter a second position state that allows communication between the first input port and the drain port when the force applied to the second pressure receiving section by the hydraulic pressure of the second flowpath is greater than the force applied to the first pressure receiving section by the hydraulic pressure of the first flowpath, and a ratio between a pressure receiving area of the first pressure receiving section and a pressure receiving area of the second pressure receiving section being equal to a ratio between a pressure receiving area of the first chamber side of the cylinder rod and a pressure receiving area of the second chamber side;

an operating member that is operable in a first direction for expanding the hydraulic cylinder from the neutral position and in a second direction for contracting the hydraulic cylinder from the neutral position;

a switching valve disposed between the first hydraulic pump and the hydraulic cylinder in the hydraulic fluid flowpath;

an adjustment path connected to the hydraulic fluid tank or to the charge flowpath;

the first flowpath having a first pump flowpath connected to the first closed-circuit port and a first cylinder flowpath connected to the first chamber;

the second flowpath having a second pump flowpath connected to the second closed-circuit port and a second cylinder flowpath connected to the second chamber; and the switching valve connecting the first pump flowpath and the second pump flowpath to the adjustment flowpath when the operating member is positioned in the neutral position.

2. The hydraulic drive system according to claim 1, wherein the shuttle valve has a spool, a first elastic member configured to press the spool from the first pressure receiving section side toward the second pressure receiving section side, and a second elastic member configured to press the spool from the second pressure receiving section side toward the first pressure receiving section side; and a ratio between an elastic constant of the first elastic member and an elastic constant of the second elastic member has an inverse relationship with the ratio between the pressure receiving area of the first pressure receiving section and the pressure receiving area of the second pressure receiving section.

3. The hydraulic drive system according to claim 2, wherein the first elastic member is attached to press the spool with a first attachment load when the spool is in a neutral position;

the second elastic member is attached to press the spool with a second attachment load when the spool is in the neutral position; and a ratio between the first attachment load and the second attachment load has an inverse relationship with the ratio between the pressure receiving area of the first pressure receiving section and the pressure receiving area of the second pressure receiving section.

4. A hydraulic drive system, comprising:

a first hydraulic pump having a first closed-circuit port and a second closed-circuit port, the first hydraulic pump being switchable between a first discharge state in which hydraulic fluid is sucked in from the second closed-circuit port and hydraulic fluid is discharged from the first closed-circuit port, and a second discharge state in which hydraulic fluid is sucked in from the first closed-circuit port and hydraulic fluid is discharged from the second closed-circuit port;

a hydraulic cylinder having a cylinder rod and a cylinder tube, the inside of the cylinder tube being partitioned into a first chamber and a second chamber by the cylinder rod, a pressure receiving area on the first chamber side of the cylinder rod being larger than a pressure receiving area on the second chamber side, the hydraulic cylinder expanding due to hydraulic fluid being supplied to the first chamber and hydraulic fluid being exhausted from the second chamber, the hydraulic cylinder contracting due to hydraulic fluid being supplied to the second chamber and hydraulic fluid being exhausted from the first chamber;

a hydraulic fluid flowpath having a first flowpath connecting the first closed-circuit port and the first chamber, and a second flowpath connecting the second closed-circuit port and the second chamber;

a hydraulic fluid tank configured to store hydraulic fluid;

a second hydraulic pump having a first open-circuit port connected to the first flowpath and a second open-circuit port connected to the hydraulic fluid tank, the second hydraulic pump being switchable between a first discharge state in which hydraulic fluid is sucked in from the second open-circuit port and hydraulic fluid is discharged from the first open-circuit port and a second discharge state in which hydraulic fluid is sucked in from the first open-circuit port and hydraulic fluid is discharged from the second open-circuit port;

a charge circuit having a charge flowpath connected to the hydraulic fluid flowpath, and a charge pump configured to discharge hydraulic fluid to the charge flowpath, the charge circuit replenishing hydraulic fluid to the hydraulic fluid flowpath when a hydraulic pressure of the hydraulic fluid flowpath is smaller than a hydraulic pressure of the charge flowpath;

a pump control unit configured to set a first target displacement for controlling a discharge flow rate of the first hydraulic pump and a second target displacement for controlling a discharge flow rate of the second hydraulic pump so that a ratio of the first target displacement with respect to a total of the first target displacement and the second target displacement equals a ratio of a pressure receiving area of the second chamber with respect to a pressure receiving area of the first chamber; and a shuttle valve having a first input port connected to the first flowpath, a second input port connected to the second flowpath, a drain port connected to the hydraulic fluid tank or to the charge flowpath, a first pressure receiving section to which the hydraulic pressure of the first flowpath is applied, and a second pressure receiving section to which the hydraulic pressure of the second flowpath is applied, the shuttle valve being configured to enter a first position state that allows communication between the second input port and the drain port when a force applied to the first pressure receiving section by the hydraulic pressure of the first flowpath is greater than a force applied to the second pressure receiving section by the hydraulic pressure of the second flowpath, the shuttle valve being configured to enter a second position state that allows communication between the first input port and the drain port when the force applied to the second pressure receiving section by the hydraulic pressure of the second flowpath is greater than the force applied to the first pressure receiving section by the hydraulic pressure of the first flowpath, and a ratio between a pressure receiving area of the first pressure receiving section and a pressure receiving area of the second pressure receiving section being equal to a ratio between a pressure receiving area of the first chamber side of the cylinder rod and a pressure receiving area of the second chamber side, the first input port and the second input port communicating with the drain port when the shuttle valve is in a neutral position state.

5. The hydraulic drive system according to claim 2, wherein the first input port and the second input port communicate with the drain port when the shuttle valve is in a neutral position state.

6. The hydraulic drive system according to claim 3, wherein the first input port and the second input port communicate with the drain port when the shuttle valve is in a neutral position state.

7. The hydraulic drive system according to claim 4, further comprising an operating member that is operable in a first direction for expanding the hydraulic cylinder from the neutral position and in a second direction for contracting the hydraulic cylinder from the neutral position;

a switching valve disposed between the first hydraulic pump and the hydraulic cylinder in the hydraulic fluid flowpath;

an adjustment path connected to the hydraulic fluid tank or to the charge flowpath;

the first flowpath having a first pump flowpath connected to the first closed-circuit port and a first cylinder flowpath connected to the first chamber;

the second flowpath having a second pump flowpath connected to the second closed-circuit port and a second cylinder flowpath connected to the second chamber; and the switching valve connecting the first pump flowpath and the second pump flowpath to the adjustment flowpath when the operating member is positioned in the neutral position.

* * * * *